US006264199B1

(12) United States Patent
Schaedel

(10) Patent No.: US 6,264,199 B1
(45) Date of Patent: Jul. 24, 2001

(54) FOLDING PUZZLE/TRANSFORMATIONAL TOY WITH 24 LINKED TETRAHEDRAL ELEMENTS

(76) Inventor: Richard E. Schaedel, 2048 Emerson St., Berkeley, CA (US) 94703

( * ) Notice: Subject to any disclaimer, the term of this patent is extended or adjusted under 35 U.S.C. 154(b) by 0 days.

(21) Appl. No.: 09/356,473

(22) Filed: Jul. 19, 1999

Related U.S. Application Data

(60) Provisional application No. 60/093,737, filed on Jul. 20, 1998.

(51) Int. Cl.[7] ..... A63F 9/08
(52) U.S. Cl. ..... 273/157 R; 273/155
(58) Field of Search ..... 273/157 R, 155, 273/156, 160, 153 R; 446/487, 488

(56) References Cited

U.S. PATENT DOCUMENTS

| | | | | |
|---|---|---|---|---|
| 1,997,022 | | 4/1935 | Stalker . | |
| 3,746,345 | * | 7/1973 | Palazzolo | 273/155 |
| 4,142,321 | * | 3/1979 | Coppa | 446/488 |
| 4,334,871 | | 6/1982 | Roane . | |
| 4,392,323 | * | 7/1983 | Rubik | 446/487 |
| 4,875,681 | * | 10/1989 | Ofir | 273/155 |
| 5,108,100 | * | 4/1992 | Essebaggers et al. | 273/157 R |
| 5,299,804 | * | 4/1994 | Stevens | 273/155 |
| 5,322,284 | * | 6/1994 | El-Agamazi | 273/157 R |

FOREIGN PATENT DOCUMENTS

| | | | | |
|---|---|---|---|---|
| 2107200 | * | 4/1983 | (GB) | 273/155 |
| 2108395 | * | 5/1983 | (GB) | 273/155 |
| 1417901 | * | 8/1988 | (SU) | 273/155 |

* cited by examiner

*Primary Examiner*—Steven Wong
(74) *Attorney, Agent, or Firm*—Howard Cohen

(57) ABSTRACT

A transformational folding puzzle assembly is formed of 24 identical tetrahedrons hingedly secured in a chain or ring. The tetrahedrons are all-space filling, and may be isosceles or other configurations. This hinged structure provides: 1) the construction of a great variety of new shapes, more than a hundred with diamond faces and hundreds more without that limitation; 2) A variety of shape dependent puzzles including a family of geometric transformational magic shapes; 3) a transformational four year calendar/ball in which the twelve months of the year are expressed on the 12 diamond faces of the ball exteriorly while the other three years are hidden in the interior of the rhombic dodecahedron ball; 4) a mechanism for holding the shapes together and joining them to one another, forming for a construction set in which each chain can transform into hundreds of other possible pieces. Alternatively, the 96 triangles of the 24 tetrahedrons may be labeled with a predetermined arrangement of the numbers 1–96, whereby the numbers on each separate rhombic dodecahedron surface will add up to the same magic constant. Other shapes have corresponding unique magic constants. Also, a plurality of eight numbered tetrahedron rings can be contracted and attached to one another in such a way that all 96 numbers and no others appear once on the exterior surface of this larger, two frequency rhombic dodecahedron shape.

34 Claims, 31 Drawing Sheets

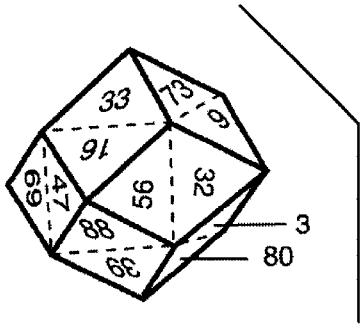
TOP (1)
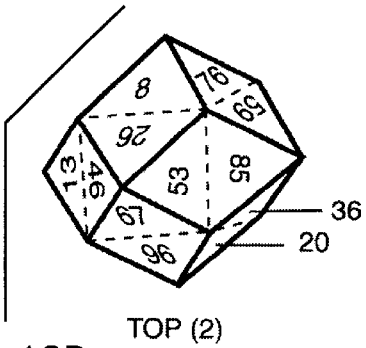
TOP (2)
FIG. 10A FIG. 10B
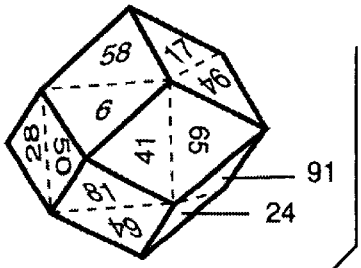
BOTTOM (1)
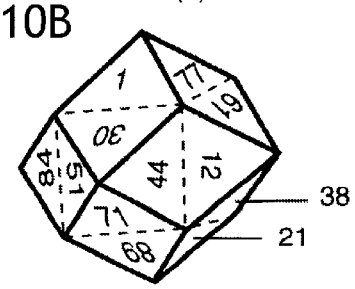
BOTTOM (2)
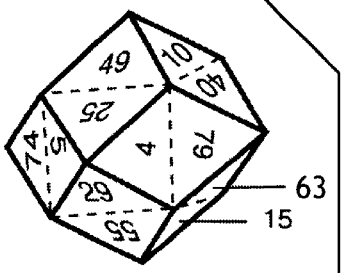
TOP (3)
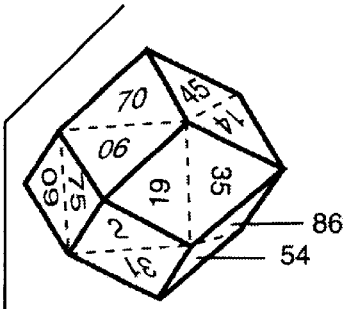
TOP (4)
FIG. 10C FIG. 10D
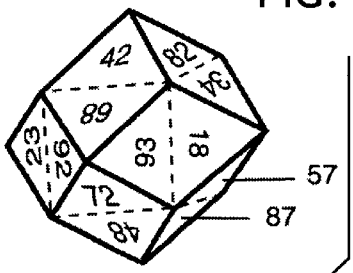
BOTTOM (3)
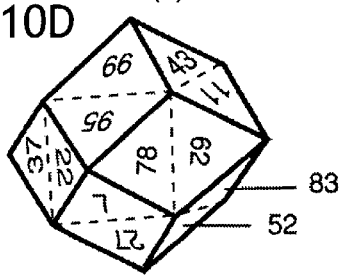
BOTTOM (4)
Every ball adds to 1164

This shape always adds to the magic constant 1746

TOP

BOTTOM

FOLDING PUZZLE/TRANSFORMATIONAL TOY WITH 24 LINKED TETRAHEDRAL ELEMENTS

REFERENCE TO RELATED APPLICATION

This application claims the benefit under 35 U.S.C. 119(e) of Provisional Application Ser. No. 60/093,737, filed Jul. 20, 1998.

BACKGROUND OF THE INVENTION

This invention relates to transformational folding puzzle assemblies, and, more particularly, to a transformational ring of 24 isosceles tetrahedrons which can be used for educational, entertainment, or advertising purposes.

Rings of rotating tetrahedrons have been known for many years. The earliest known relevant patent, U.S. Pat. No. 1,997,022 to Stalker in 1933, presented the original use for such rings as an advertising medium or toy. While it mentions larger tetrahedron rings, the preferred embodiment (pictured in the patent) is a ring of six or eight isosceles tetrahedrons. The concept is described in Ball & Coxeter, *Mathematical Recreations and Essays,* along with an arrangement of the numbers from 1 to 32 by Heath on "a magic rotating ring" of eight regular (not isosceles) tetrahedra. Doris Schattschneider and Wallace Walker copyrighted various isosceles tetrahedron rings of 6 to 12 members which they covered with M. C. Escher tessellated patterns and termed them kaleidocycles. The entertainment value of Stalker's assembly and Walker/Schattschneider's rings involve the visual appearance and transformation of colors and images when the connected bodies are simultaneously rotated upon their individual axes (at opposite edges of the ring towards the center) to bring disparate surfaces into edge-adjacent, abutting relationship. For this particular effect it is important to have less tetrahedra (the minimum for a tetrahedron ring is six), generally six to eight.

Rings of tetrahedra that are meant to be "flipped and folded" to make solid geometrical shapes, rather than to make changing patterns, are also Unavailable. One such manifestation, made out of cloth hinges and plastic tetrahedrons features two colors and 12 irregular right tetrahedrons. Depicted on the descriptive packaging for this product are about 18 shapes that can be made by folding up the ring. The only graphic differentiation between the triangular paces of the tetrahedrons is that they come in two different colors. No means of holding the shapes together is given; in general the arrangements are held together simply by the inertial weight of the plastic tetrahedrons upon one another.

A major disadvantage of the prior art in relation to rotating tetrahedron rings concerns this separation between the two methods of designing tetrahedron rings. If the only effect desired from a rotating tetrahedron ring is the kaleidoscopic effect of different faces tumbling in towards the center of the ring as the ring is rotated about its closed loop axis, then the most important factor is that each of the four triangular faces of each tetrahedron in the ring be graphically different (either in color or design) and that the ring be of small size (6 to 12 tetrahedrons) so this effect can be easily seen. If the primary effect desired from a tetrahedron ring is that it contract to form various random solid shapes, the most important factor is that the tetrahedrons be "allspace-filling", so that there are no irregular gaps or voids between or among the surfaces of the contracted shape, and that the ring be of large size (12 or more tetrahedrons).

Prior art involving the arrangement of magic numbers on the surface of a rotating tetrahedron ring has several disadvantages. The only described version (Heath) has only one true connection with exterior shape, which is that there is a magic constant (the sum of all four triangles) for each tetrahedron contained on the ring. Other magic constants he describes involve tracing out patterns mentally as the viewer travels in a spiral fashion around the ring. Heath's version (published in Ball & Coxeter, Mathematical Recreations and Essays, p. 216) is depicted as consisting of equilateral triangles and makes a ring of eight regular tetrahedrons. It is a geometric fact that the regular tetrahedron is not an all-space filling tetrahedron. Thus this prior art "magic number" ring necessarily belongs to the category of tetrahedron rings which are meant to rotate towards the center and cannot be contracted into coherent solid shapes with no gaps between the tetrahedrons. Therefore, while Heath suggests a number of magic constants of greater magnitude than the sum of the triangles on every tetrahedron, none of them are related to a larger, contracted, all-space filling shape.

Accordingly, it would be desirable to have a rotating tetrahedron ring that has:

1) sufficient size to use the capacity of all-space filling tetrahedrons to be grouped to form a large plurality of geometric solid-shapes; and, 2) sufficient graphic intricacy involved in the color/design/arrangement of the triangular faces such that, at a minimum, each contracted shape has at least four visually distinct representations. In addition it would be desirable that in order to fully explore the potentials of the relationship between design and shape, that the shape be held together in such a way that it does not come apart when it is picked up. Accordingly an external or internal means should be provided for holding the tetrahedron ring together in various contracted shape configurations.

SUMMARY OF THE INVENTION

The present invention generally comprises a transformational folding puzzle assembly formed of a chain or ring of 24 isosceles tetrahedrons. The tetrahedrons are identical in configuration, and are all-space filling. One aspect of the invention is to combine the hitherto separate properties of tetrahedron rings, i.e., rotatability as a ring and contractility to form solid shapes, such that the contracted solid shape and the color/design of the faces are intimately related in order to make an entertaining toy, puzzle, educational, or novelty item. Depending on decoration and manipulation, it is capable of forming a variety of puzzles involving shapes, figures, and numbers; in addition, a plurality of such toys can be made into both large and small scale construction sets.

Another object of the invention is to go beyond the prior art by exploiting properties of the tetrahedral ring and solid shapes formed thereby that were heretofore undiscovered. For example, the invention provides: 1) the construction of a great variety of new shapes, more than a hundred with diamond faces and hundreds more without that limitation; 2) A variety of shape dependent puzzles including a novel family of geometric transformational magic shapes; 3) a transformational four year calendar/ball in which the twelve months of the year are expressed on the 12 diamond faces of the ball exteriorly while the other three years are hidden in the interior of the rhombic dodecahedron ball; 4) a means of holding the shapes together and of attaching them to one another, allowing for a construction set in which each piece can transform into hundreds of other possible pieces.

These objects are achieved by a ring (endless loop) or broken ring (chain) made up of 24 interconnected isosceles tetrahedrons. This invention incorporates unique physical properties of such a ring or chain, as follows. When a suitable arrangement of four different colors for the four different faces of each tetrahedron is given, the ring may be contracted into four distinguishable rhombic dodecahedron balls, each ball having a different, solid exterior color. In addition, if each of the twelve diamond faces on the exterior surface of the contracted rhombic dodecahedron balls is provided with a predetermined display of the day arrangement for a month, a four year calendar can be created with each of the four contracted dodecahedron ball arrangements representing one calendar year.

Alternatively, if the 96 triangles of the 24 tetrahedrons are covered with a predetermined arrangement of the numbers from 1 to 96, the numbers on each separate rhombic dodecahedron surface will add up to the same magic constant: 1164. Further play possibilities can involve discovering the other different shapes which have the same property of adding up to the same numerical constant, as well as investigating the possibility of other numerical constants involved in various shapes formed by the tetrahedrons.

In addition a plurality of eight such numbered 24 tetrahedron rings can be contracted and attached to one another in such a way that all 96 numbers and no others appear once on the exterior surface of this larger, two frequency rhombic dodecahedron shape. Various means of holding together the ring of tetrahedrons are given, including clips, magnets, Velcro, and the like. Since every triangle of the 24 tetrahedron ring is composed of angles of 70.53°, 54.74°, and 54.74°, only one kind of triangle is required for the entire ring, making production layout and prototyping simple.

A further educational aspect of the invention is that the ring of tetrahedrons may form a large number of different shapes, all of them all-space filling, and all having widely varying surface areas. Thus the different shapes, which all have the same enclosed volume (the sum of the volumes of the 24 tetrahedrons), have greatly differing surface-to-volume ratios. This ratio is easily determined by counting the exposed tetrahedral faces for any shape formed from the tetrahedral ring.

Another aspect of the invention is the provision of two rings of tetrahedrons, the two rings defined by bisecting a single ring of 24 all-space filling isosceles tetrahedrons. These two rings may be combined to form any of the shapes or configurations described with respect to the single ring described above. In addition, each of the pair of rings may be manipulated to form other unique shapes, including cubic forms, crown forms, and the like.

The following terms used herein are defined as follows:

Isosceles tetrahedron: A convex four sided polyhedron in which each face has equal triangles having angles of 70.53°, 54.74°, and 54.74°.

Rhombic dodecahedron: A vertically regular polyhedron composed of twelve congruent diamond (parallelogram) faces having angles of 109.47° and 70.53°, with a dihedral angle of 120°.

Triangular face: As used herein, refers to a face with angles of 70.53°, 54.74°, and 54.74°.

Diamond face: As used herein, refers to a diamond face made by combining two triangular faces along their long folding edge so that they are coplanar and together form a single face of 109.47° and 70.53°.

Obtuse Rhombohedron: A shape with six exterior diamond faces. It has two opposite vertices at which the three face angles are equal and obtuse.

Two frequency rhombic dodecahedron: Frequency is a measure of the number of segments of which each edge of the "parent polyhedron" is subdivided. A two frequency rhombic dodecahedron means that each edge of the original rhombic dodecahedron is divided into two segments. This results in a solid figure with 48 diamonds on the surface, four times more than the parent rhombic dodecahedron of 12 diamond faces.

Contracted shape: a shape made from a rotating ring or chain of tetrahedra in which at least two of the faces of two adjacent tetrahedra press up against one another, causing such faces to be no longer visible on the exterior of the shape.

Magic Shape: A certain contracted shape made out of a ring of twenty-four tetrahedrons (with a predetermined configuration of 96 numbers on the triangular faces) such that all the numbers on the exterior surface of the shape will always add up to the same constant no matter which set of numbers is exposed on the surface.

BRIEF DESCRIPTION OF THE DRAWINGS

FIG. 10A–10D depicts top and bottom views of the numbers on the four possible configurations of a rhombic dodecahedron ball made from the folded sheet of FIG. 9.

DESCRIPTION OF THE PREFERRED EMBODIMENTS

Figure 1:
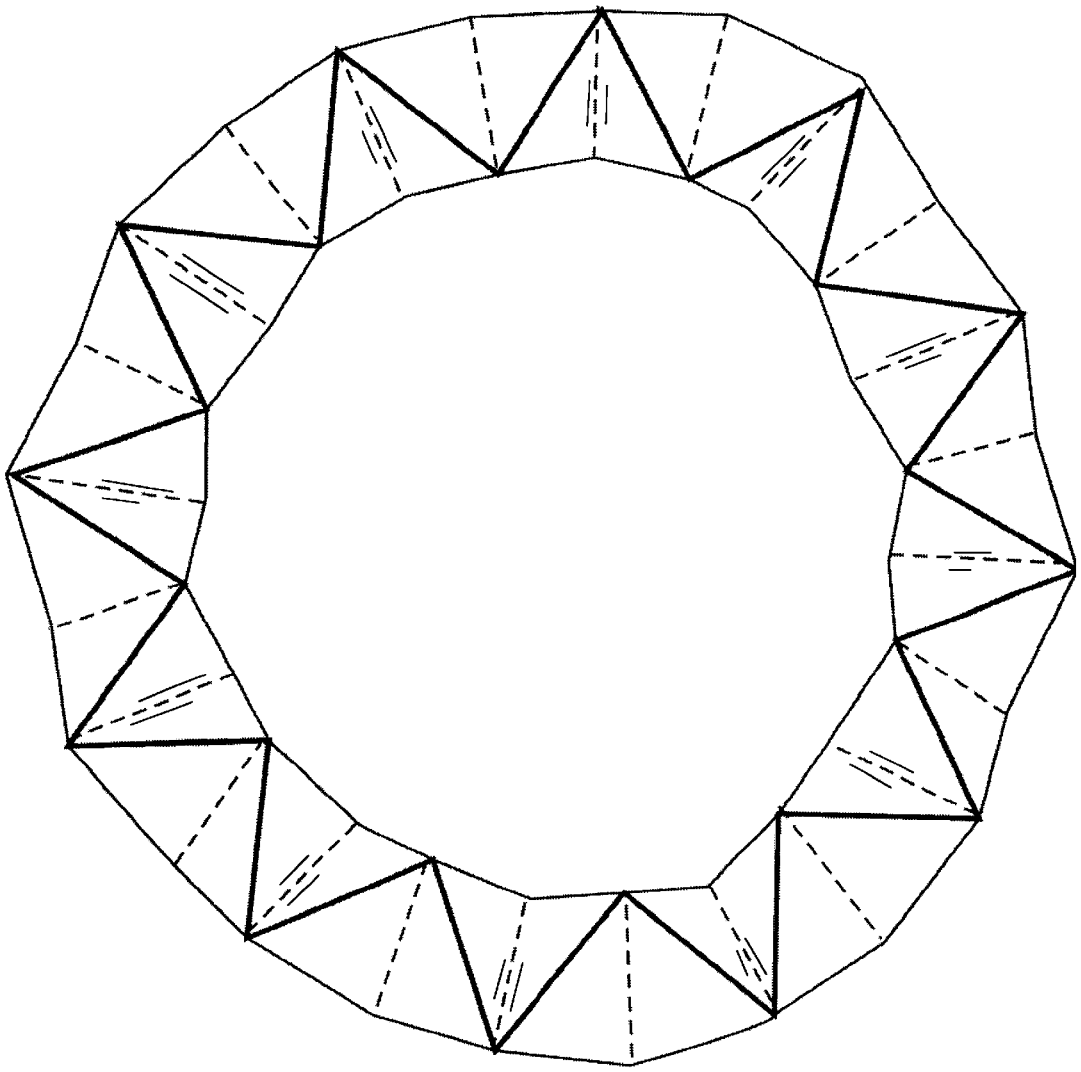
FIG. 1 is a perspective view of the tetrahedron ring in its expanded form.

The present invention generally comprises a transformational folding puzzle assembly formed of a chain or ring of 24 tetrahedrons. The tetrahedrons are identical in configuration, and are all-space filling. With regard to FIG. 1, one embodiment is comprised of isosceles tetrahedrons joined edge-to-edge in hinged fashion in a ring (endless loop), so that each tetrahedron may be pivoted with respect to the respective adjacent tetrahedrons. Each isosceles tetrahedron is formed of four triangular faces having angles of approximately 70.53°, 54.74°, and 54.74°. The tetrahedrons are joined to each other at their base (longest) edges.

The tetrahedron ring may be rotated about the ring axis, and may also be folded into a wide variety of shapes. The pleasure and challenge of the tetrahedron ring as a toy and amusement involves discovering the various shapes that can be formed. In addition, the invention exploits many heretofore undiscovered properties of the tetrahedron ring, generally involving indicia, colors, and patterns applied to the triangular faces of the ring, as described in the following specification.

Figure 2:
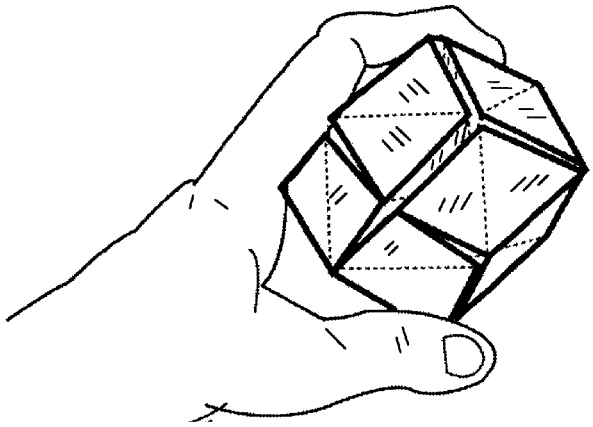
FIG. 2 is a perspective view of the tetrahedron ring in its most contracted form, the rhombic dodecahedron ball.

With regard to FIG. 2, one shape that may be formed by manipulating the tetrahedron ring is a rhombic dodecahedron ball. The rhombic dodecahedron is a vertically regular convex polyhedron in which all its 12 diamond faces (two triangular faces form one diamond) are equal (parallelograms having angles of approximately 109.47° and 70.53° and all its polyhedral angles are equal (120°). It has a visual regularity and symmetry which is pleasing to the eye. Due to the fact that 24 triangular faces are exposed, it follows that 72 triangular faces are hidden. Furthermore, the ring may be folded into a rhombic dodecahedron in many different ways to expose many different combinations of triangular faces. A hand in this case is holding the contracted shape together, which may be the preliminary step before using an attachment method, such as paper clips or rubber bands, to retain the tetrahedron ring in the rhombic dodecahedron form.

Figure 3:
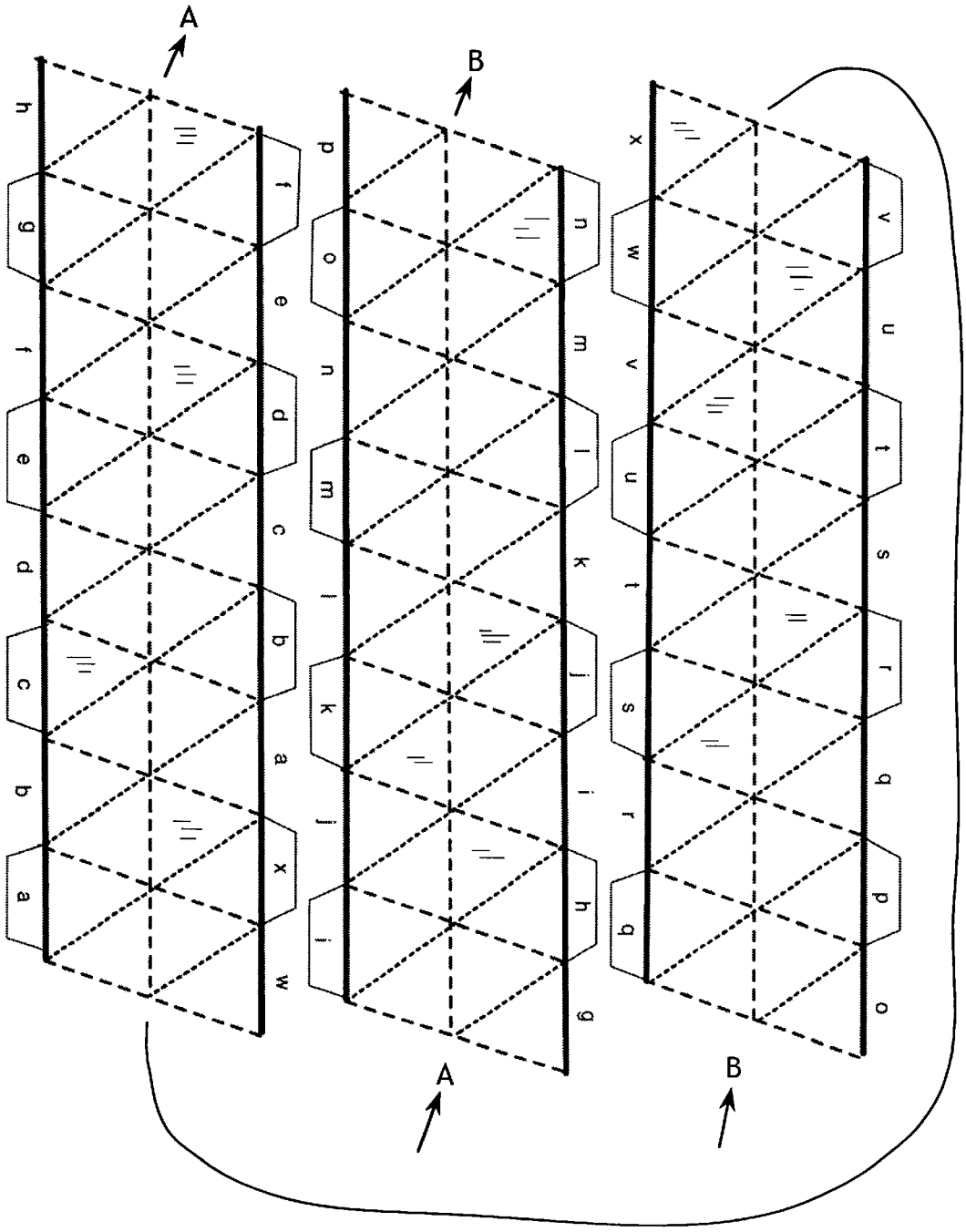
FIG. 3 is a plan view of a scored blank of sheet material, such as card stock, from which the articles in FIG. 1 and 2 are made.

The tetrahedron ring can be formed from a sheet of card stock, paper, plastic or the like if scored and bent correctly, as described in prior art (viz. Stalker patent). A model of the 24 tetrahedron ring can be constructed from the plane sheet of FIG. 3, in which the blank is shown in three sections to fit within the drawing. The ends of each of the three section are joined (A to A, B to B) to form a single integral blank. The blank is scored on all interior lines, and folded up or down as indicated along the scored lines; i.e., all finely broken lines are folded upwardly, and all broadly broken lines are folded downwardly. The edges are then joined with tabs; i.e., tab h is applied to edge portion h, tab g is applied to edge portion g, and so on. Indeed, the tetrahedron ring may be sold and distributed as a flat sheet formed as shown in FIG. 3, and a part of the fun and challenge of the toy may be to construct the complete ring.

For the teachings of the embodiments of this invention it is advantageous to be able to show the entire graphic content of the exterior surface of the 24 tetrahedron ring on a planar arrangement in two dimensions; for this reason, subsequent embodiments are referred to this method of constructing 24 tetrahedron rings from flat sheets of card stock paper. This is not meant to exclude other preferred embodiments that can be made out of plastic, cloth or metal; these would have the same appearance in terms of graphic content as the cardstock tetrahedron rings, but would not necessarily derive from a similar construction method of bending, folding, and gluing together a single sheet of material. In some embodiments the tetrahedrons could be made out of four plastic triangles glued or otherwise joined together, and these could be attached by plastic, metal, or cloth hinges. Likewise, the tetrahedrons may be molded, extruded or embossed using solid resin, plastic, foamed plastic, wood, or the like, and joined by any suitable hinge known in the prior art. The hinges may be separate components linking separate tetrahedrons, or the hinges may be "live" integral portions of a plastic or polymer structure. Furthermore, the hinges may be formed by a web or film bearing color, indicia, or artwork and superficially applied to more than one tetrahedron, whereby the flexible web or film hingedly joins the tetrahedrons.

Figure 4:
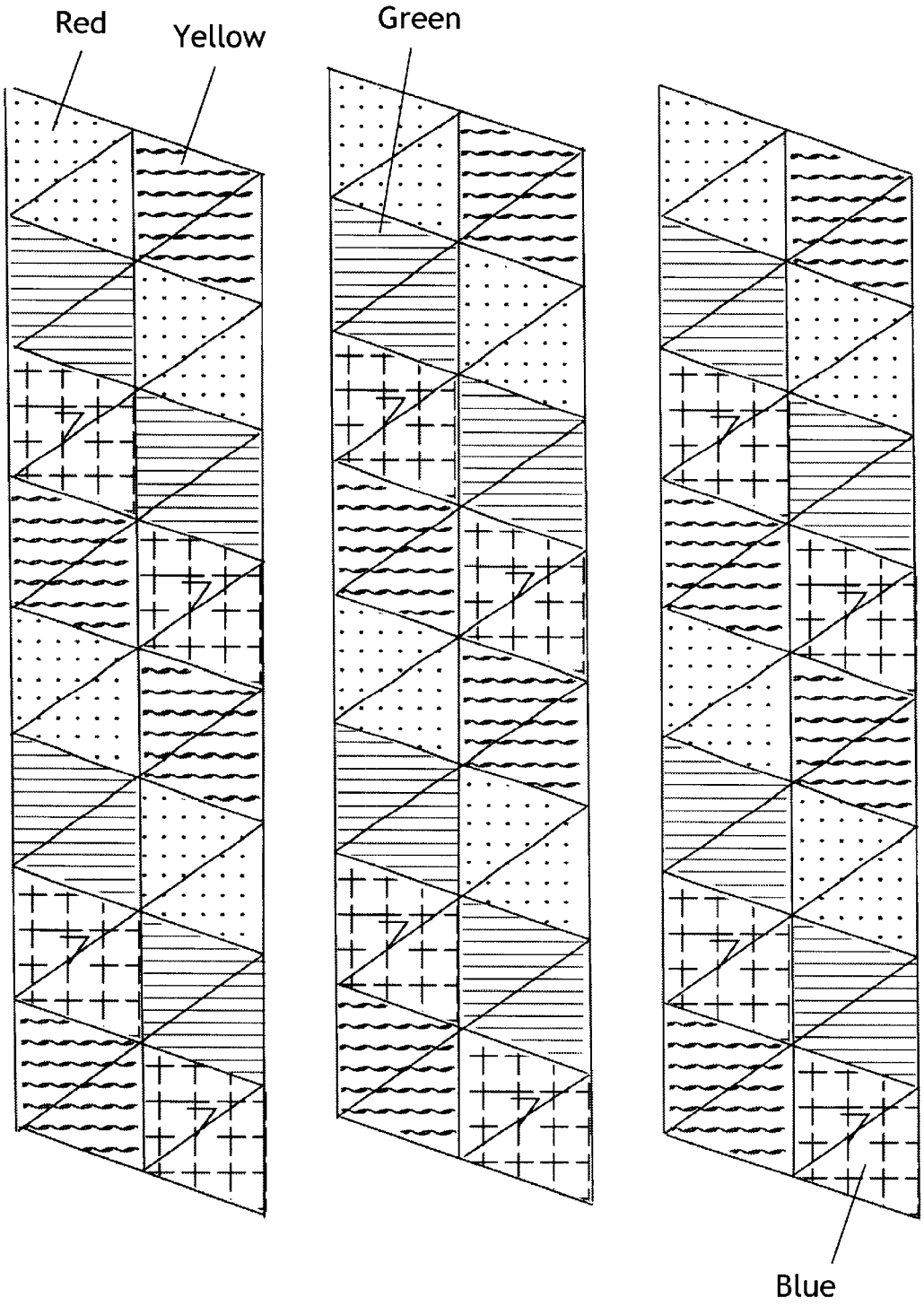
FIG. 4 is a plan view of a scored blank of sheet material, in which a group of four colors are arranged.

With regard to FIG. 4, one preferred embodiment of the invention involves an arrangement in which each tetrahedron has four colors, for example red, yellow, blue and green triangles, represented by the different hatching patterns of FIG. 4. If the different colors are applied to the triangular facets as shown in the drawing, then the 24 tetrahedron ring can be contracted to form four different rhombic dodecahedrons, with all the exterior faces of each rhombic dodecahedron being all of one color. In addition, there may be substituted for each color a portion of an image or photograph. For example, portions of photos of the entire surfaces of the earth, moon, mars, and Venus may be substituted for the four colors and arrayed appropriately in accordance with the pattern of FIG. 4, whereby the tetrahedron ring may be folded and refolded to produce the appearance of the earth and the three closest heavenly bodies.

Figure 5:
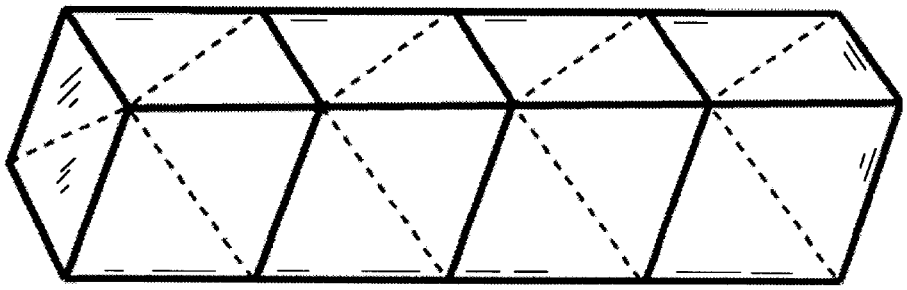
FIG. 5 depicts the beam shape that can be made from the folded sheet of FIG. 4.
Figure 6:
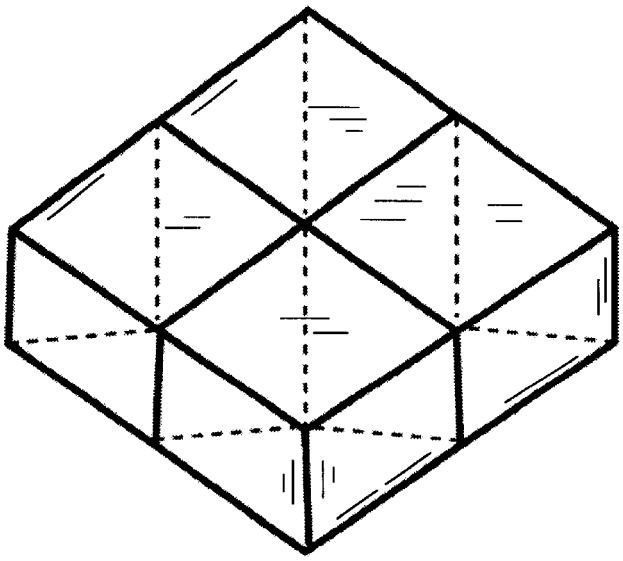
FIG. 6 depicts the plinth shape that can be made from the folded sheet of FIG. 4.

While it is a striking feature of the invention that four differently colored rhombic dodecahedrons can be made from one tetrahedron ring, another attractive feature is the number of puzzling shapes that require certain unobvious moves of manual dexterity to accomplish. These often require holding one contracted part of the ring together with some of the fingers of both hands while using the other fingers to twist other parts of the ring in place. One such configuration is the "beam" configuration (FIG. 5) which has 36 exposed triangles. This is educational in that it shows in easily computed ratios how volume and surface area are affected by shape. Since the volume of the 24 tetrahedron ring remains the same in all shapes, due to the all-space filling characteristic of the tetrahedrons, changing the shape and counting the number of diamond faces that are visible on the outside surface allows for easily discoverable relationships between shape and surface area. The "beam" (FIG. 5) has of course equal volume but 3/2 times the surface area of the rhombic dodecahedron shape. Another shape having 4/3 the surface area of the rhombic dodecahedron is the "plinth" (FIG. 6). Shapes can be constructed featuring 48 triangles on the outside which have twice the surface area of the rhombic balls.

Figure 7:
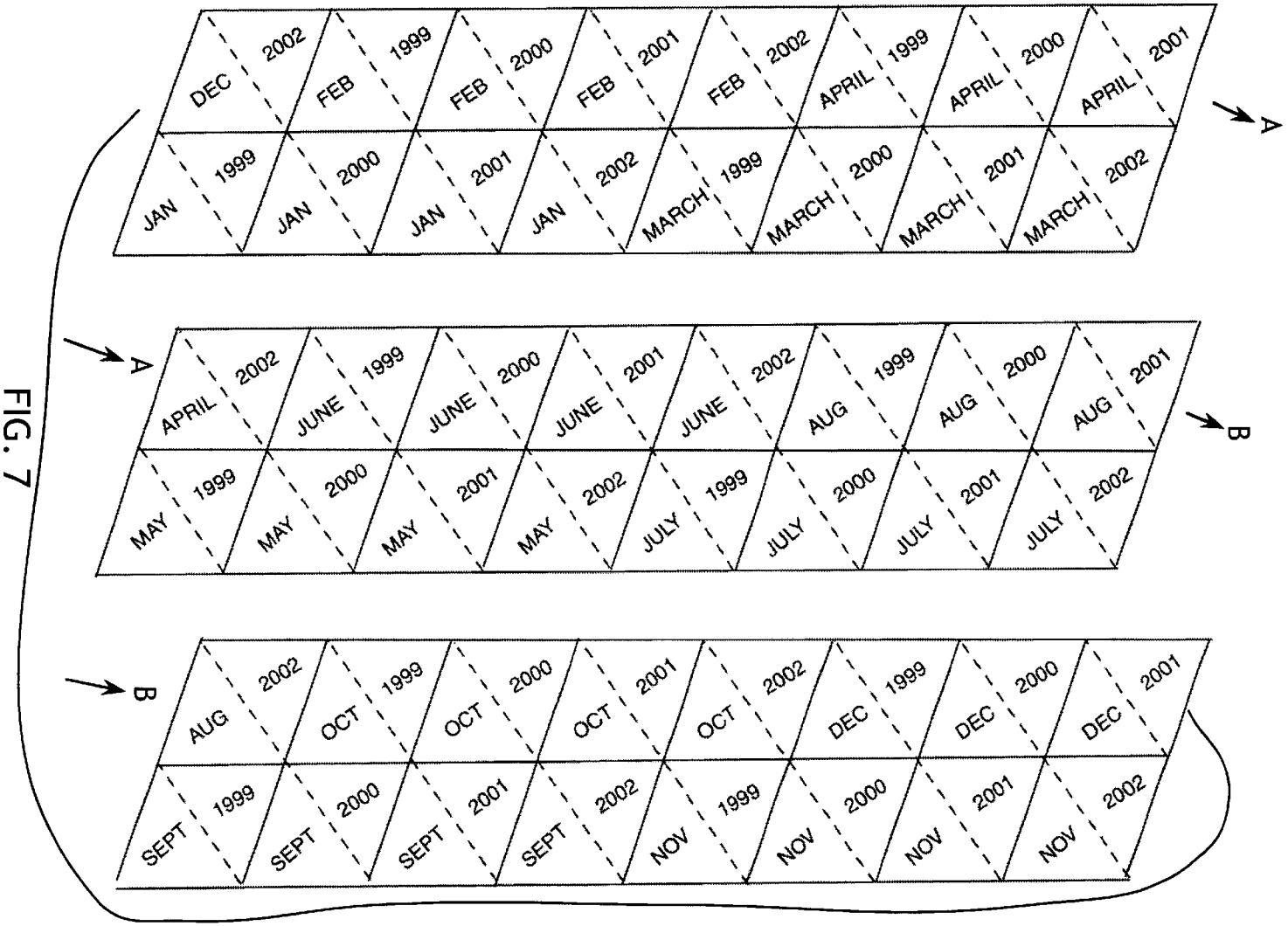
FIG. 7 is a plan view of a scored blank of sheet material, bearing a predetermined calendar arrangement in which the 48 months for the years 1998, 1999, 2000, and 2001 are displayed.
Figure 8A:
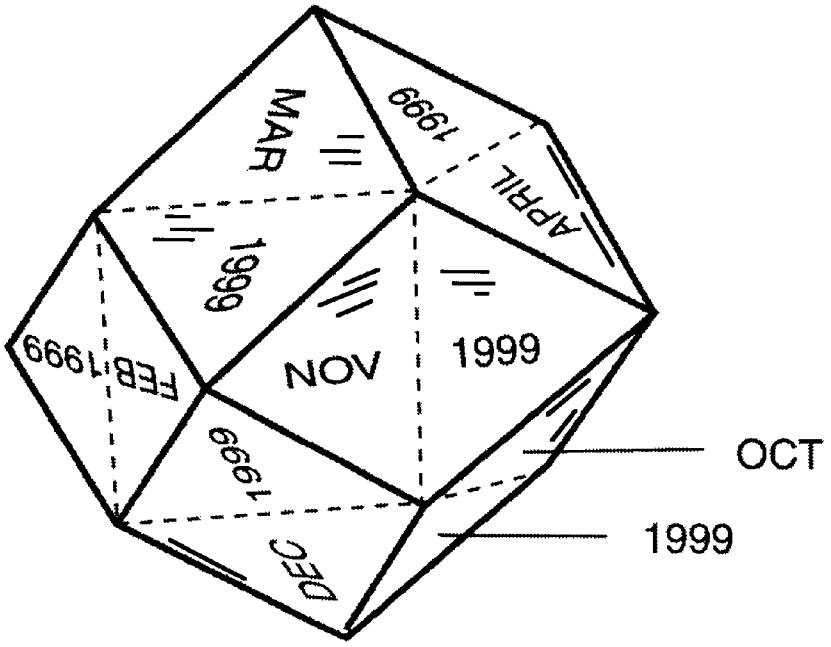
FIGS. 8A and 8B are perspective top and bottom views showing the months of the year 1999 depicted on the surface of the rhombic dodecahedron contracted shape made from the folded sheet of FIG. 7.
Figure 8B:
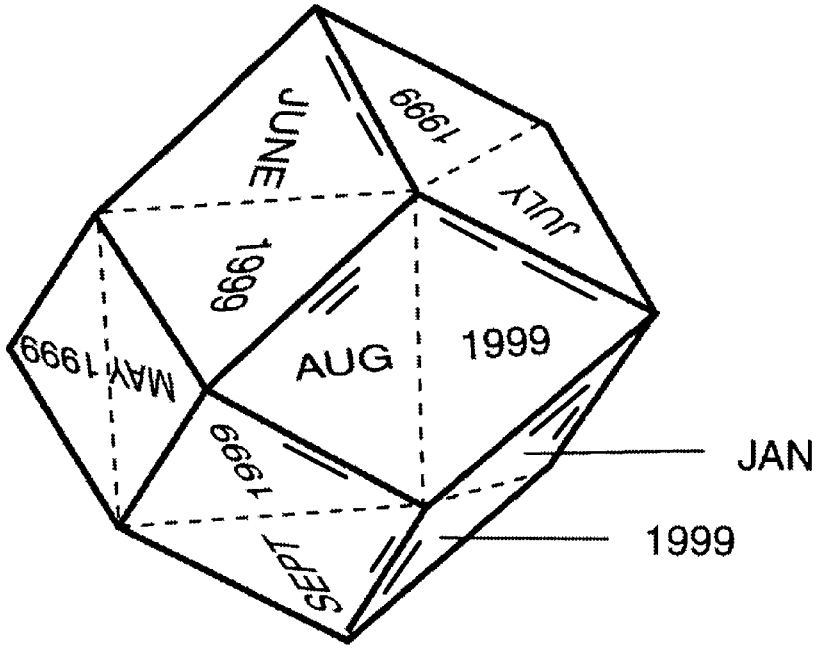

With regard to FIG. 7, another preferred embodiment of the invention takes advantage of another unique property of the tetrahedron ring that was heretofore unknown. In this embodiment each month, including all the days of that month (not shown) of 4 consecutive years (48 months) is arranged in a "diamond" (rhombic) arrangement on adjacent hinged triangular faces which connect the tetrahedra. When this ring is contracted into the rhombic dodecahedron ball shape, as in FIGS. 8A and 8B, it can display all the months of a single year for each ball configuration. Note also that three serial months are grouped about each vertex (October-November-December in FIG. 8A, June-July-August in FIG. 8B). Such four year calendars would have especial value for commemorating four year periodic events such as presidential inaugurations, incoming college freshman, and sports events such as Olympics or World Cup soccer. Such calendars could be imprinted likewise with logos from these events to make a valuable souvenir.

Another striking property of the tetrahedron ring is the magic shape feature; i.e., the numbering of all of the triangular faces of the tetrahedrons in a unique arrangement that yields unique outcomes. With regard to FIG. 9, there is shown a numbering arrangement that may define a plurality of magic shapes. A series of numbers from one to 96 (or (1+n) to (96+n)) is applied to the 96 triangles of the 24 tetrahedron ring such that each triangle has a separate number on its face. The magic number aspect of the puzzle involves the user in trying to discover a certain set of shapes out of all possible shapes that is characterized by all the numbers on the exposed triangular faces adding to the same constant, no matter which triangular faces are exposed on the exterior of the shape or hidden in the interior. That is, the same sum will always result from that shape, no matter how the tetrahedrons are arranged to form that shape. Only a few shapes with all diamond faces (out of more than 100) meet this "magic" requirement. For example, with reference to FIGS. 10A–10D, the exposed numbers of every one of the four distinct rhombic dodecahedrons that can be made from contracting the tetrahedron ring of FIG. 9 add up to the magic number 1164. Finding the magic number for a given shape and proving its constancy among all configurations that can make a given shape is one aspect of the challenge and enjoyment of the puzzle.

Figure 9:
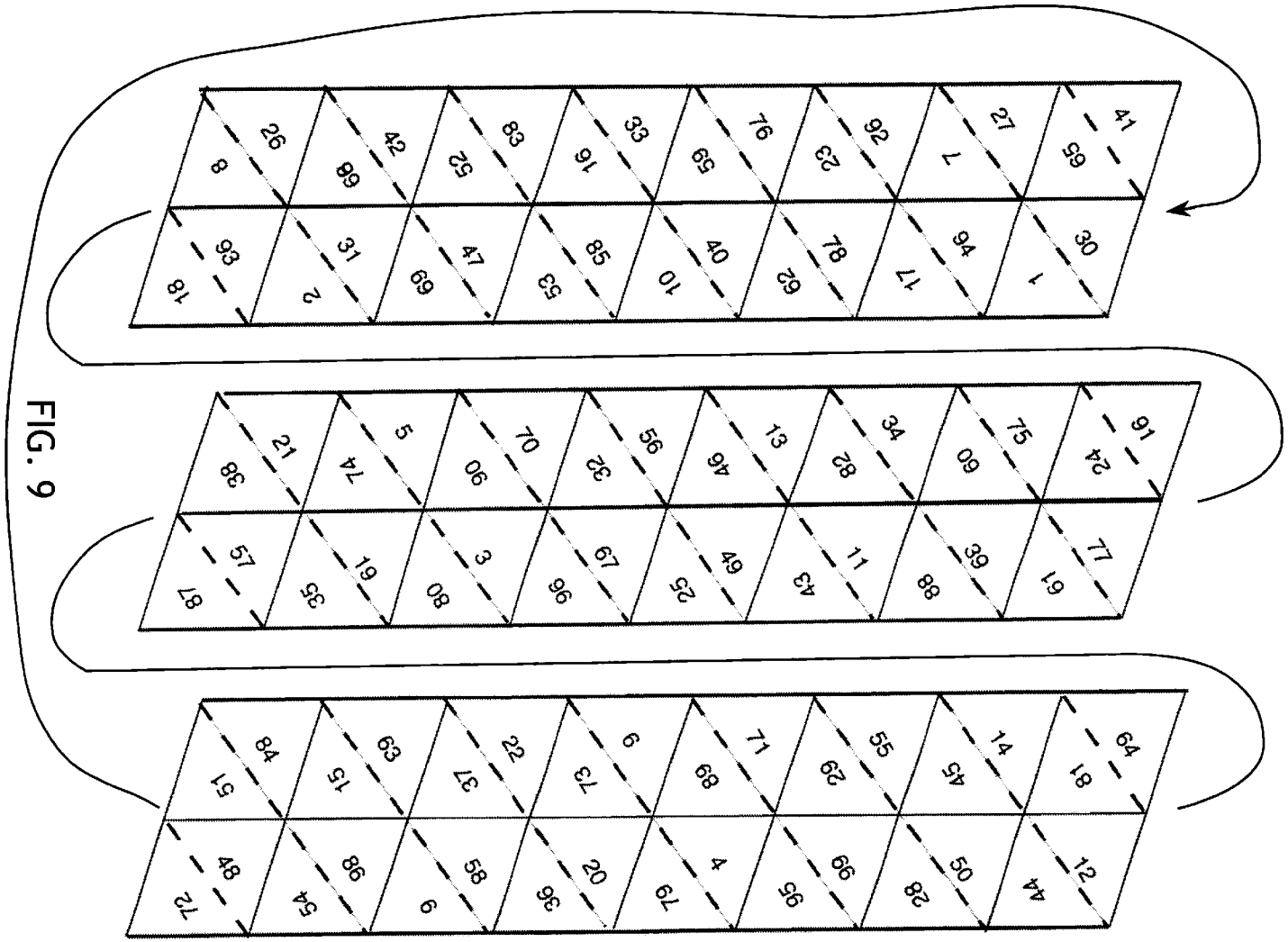
FIG. 9 is a plan view of a scored blank of sheet material for forming the tetrahedron ring, showing one preferred arrangement of the integers from 1 to 96 on the 96 triangles of the scored sheet.
Figure 11:
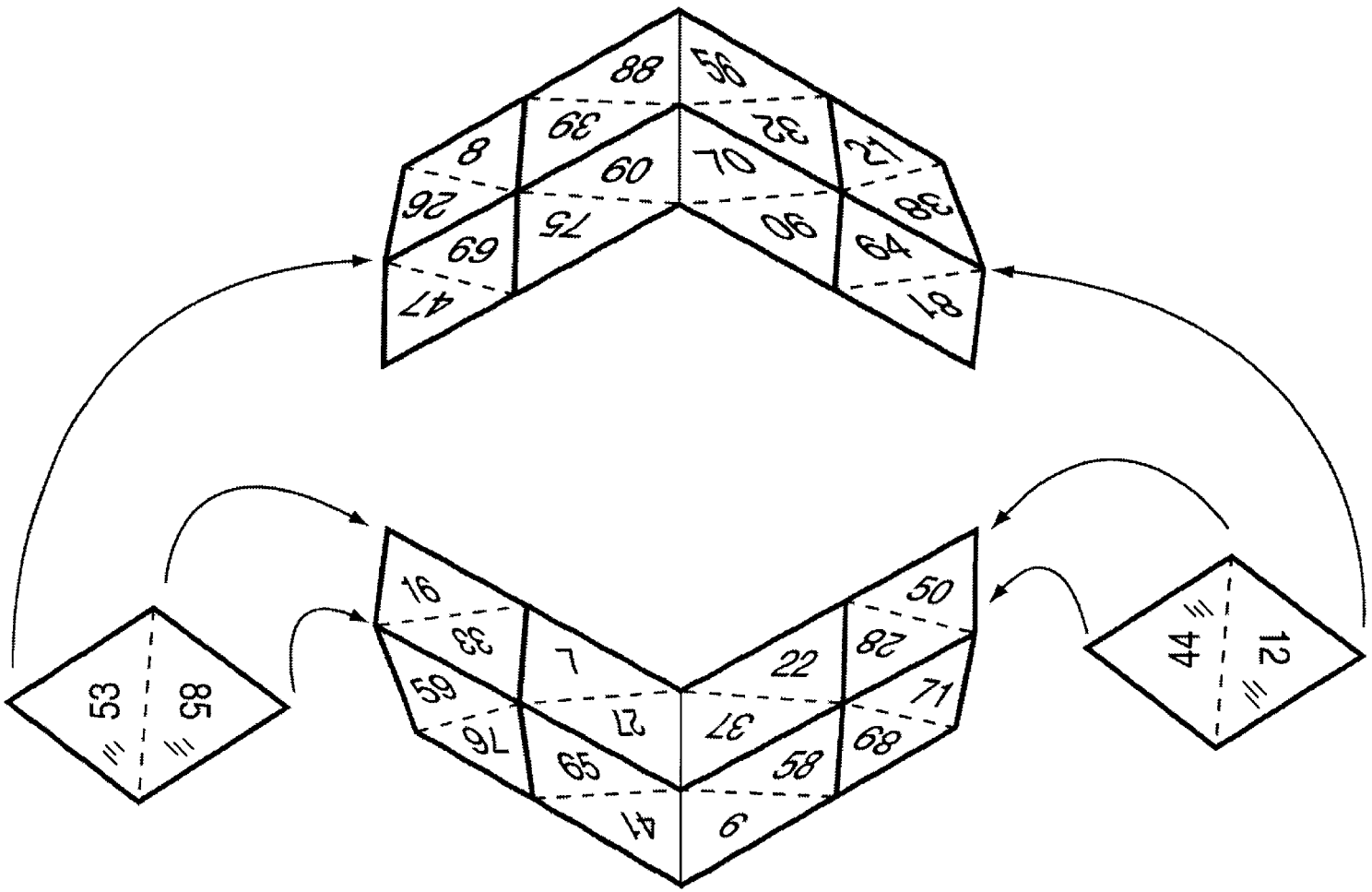
FIG. 11 depicts a composite view of a "W" Magic Shape made from the folded sheet in FIG. 9, showing all the exposed faces thereof.
Figure 12B:
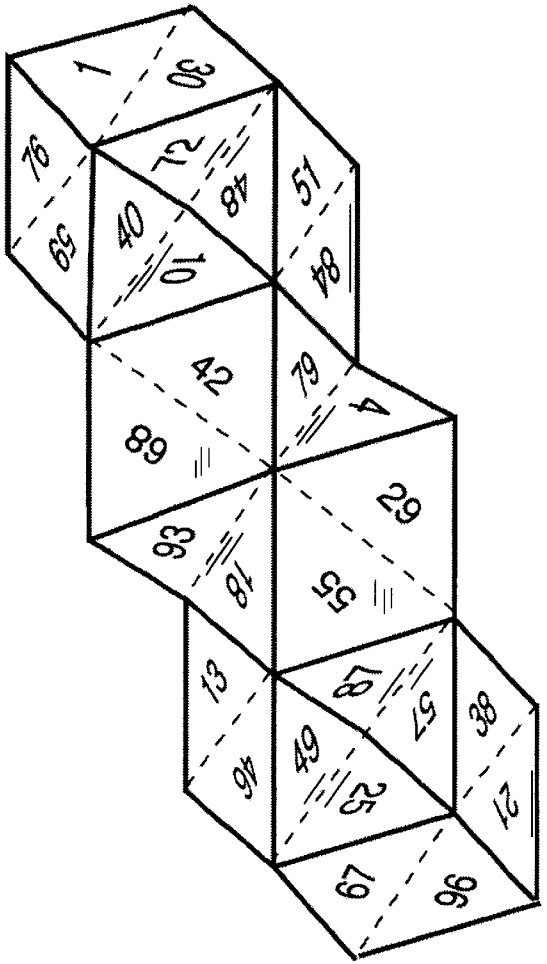
FIGS. 12A and 12B depict front and rear views of a "double spiral" Magic shape made from the folded sheet of FIG. 9.
Figure 12A:
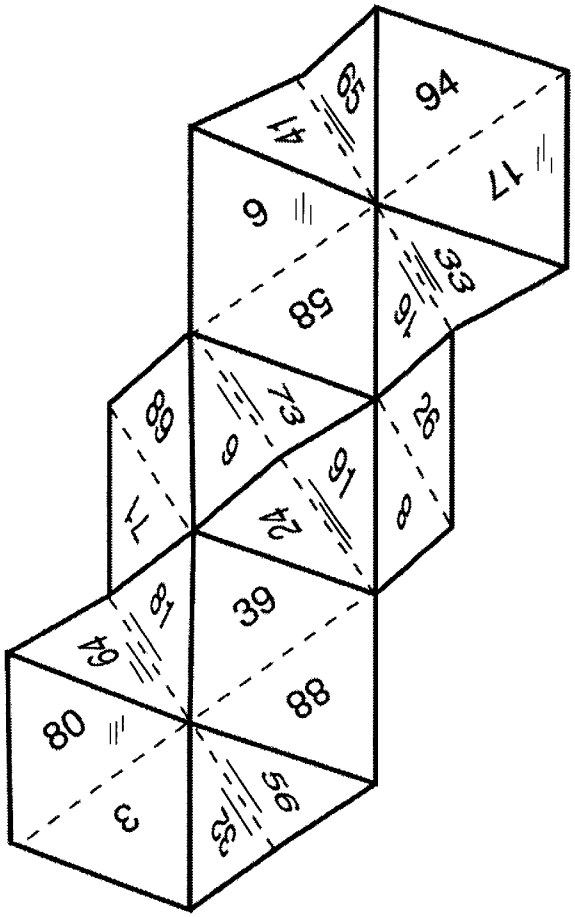

Other magic shapes may be formed using a numbered facet layout as in FIG. 9. For example, with reference to FIG. 11, a "W" configuration may be formed by the tetrahedron ring, and any such configuration exposes numbered faces that add to the magic constant 1746. Likewise, the double spiral configuration (FIG. 12) formed by the tetrahedron ring exposes faces that add to the magic constant 2134.

Thus by making an explicit connection between shapes made by contracting all the tetrahedrons together of a tetrahedron ring, and adding up the exposed exterior numbers on these contracted shapes, this invention becomes a unique geometrical transformational magic toy, in which the toy can be transformed into a variety of different shapes having several different magic constants. Generally in geometric puzzles involving shapes, there is usually no particular reason for selecting among shapes other than aesthetics or difficulty of construction. This embodiment offers a distinct advantage over the prior art in that it offers an incentive to experiment in making new shapes in order to discover one that has a magic constant. The provision of a geometric puzzle having arithmetic considerations combines both spatial concepts and mathematical exercise, resulting in great mental stimulation and an enjoyable puzzle-solving experience.

Figure 13:
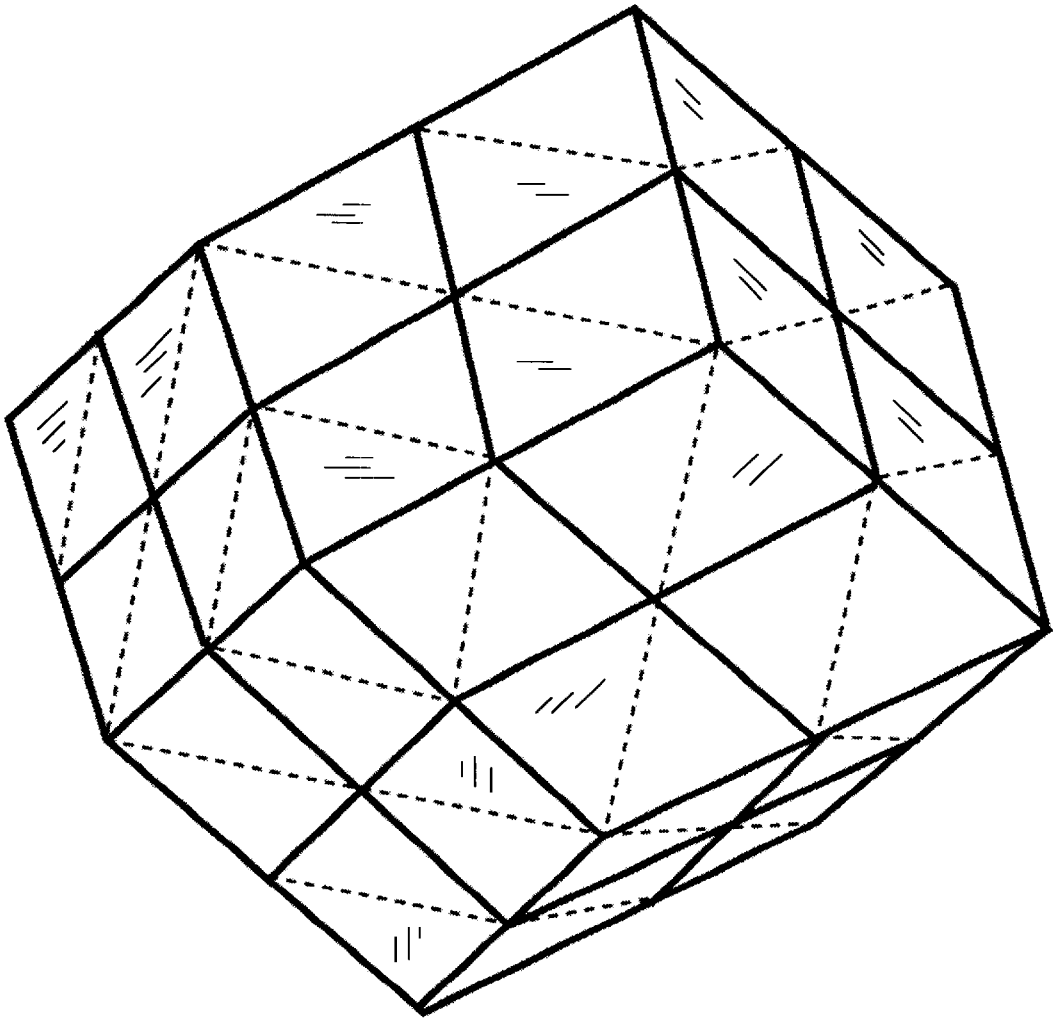
FIG. 13 is a perspective view of a two frequency rhombic dodecahedron.
Figure 14:
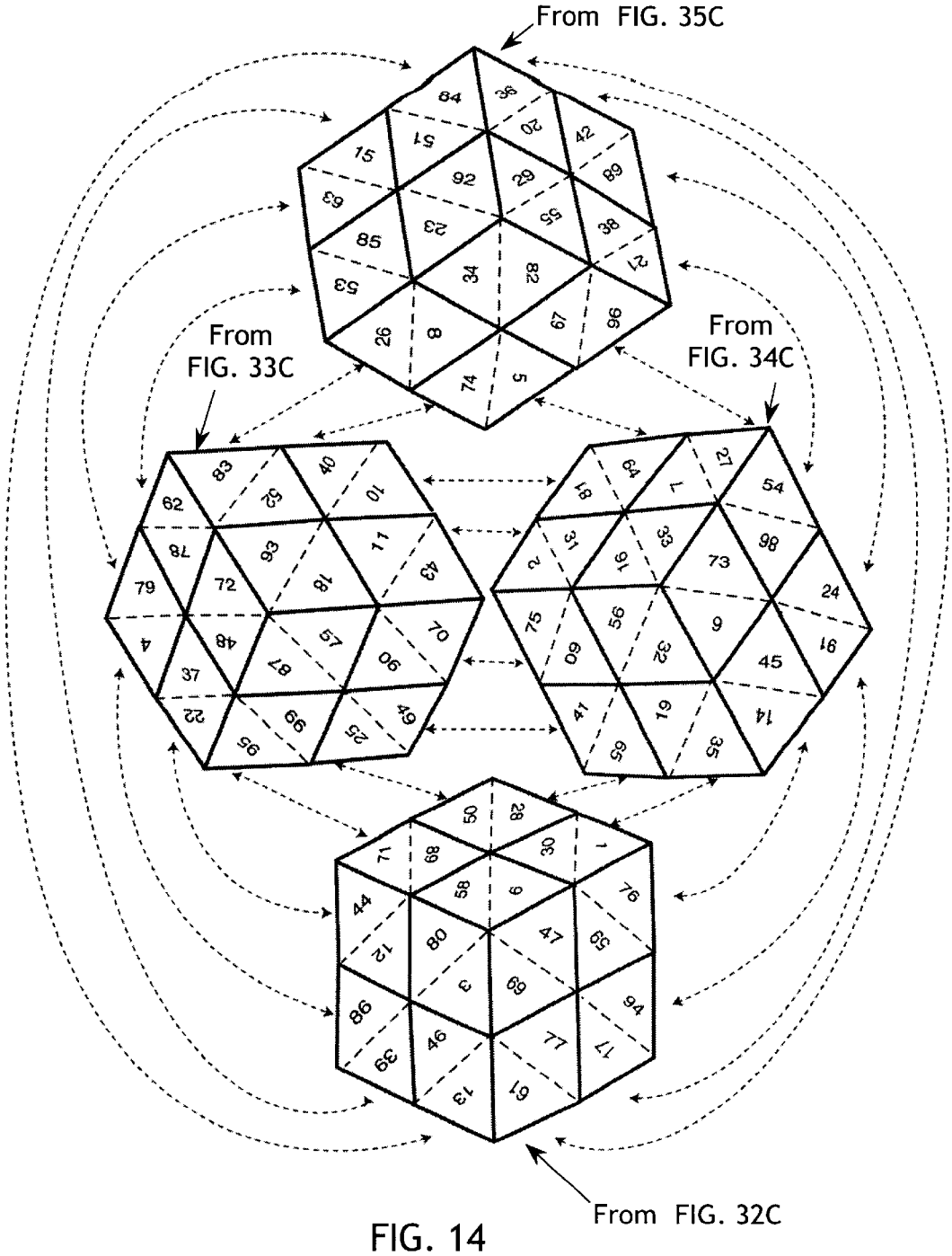
FIG. 14 is a chart showing the steps required to construct a two frequency rhombic dodecahedron from eight folded shapes having numerical indicia as shown in FIG. 9, displaying all the integers from 1 to 96 without repetition.
Figure 32A:
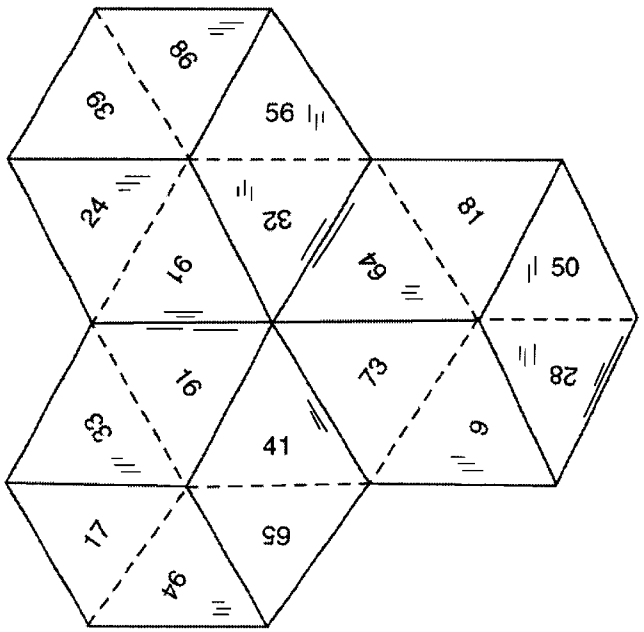
FIGS. 32A–32C are perspective views showing two Itrigons (trilobed shapes of FIGS. 32A and 32B) formed of the tetrahedron rings bearing the numbered pattern of FIG. 9, and a resulting obtuse rhombohedron shape (FIG. 32C) formed of the two Itrigons.
Figure 32B:
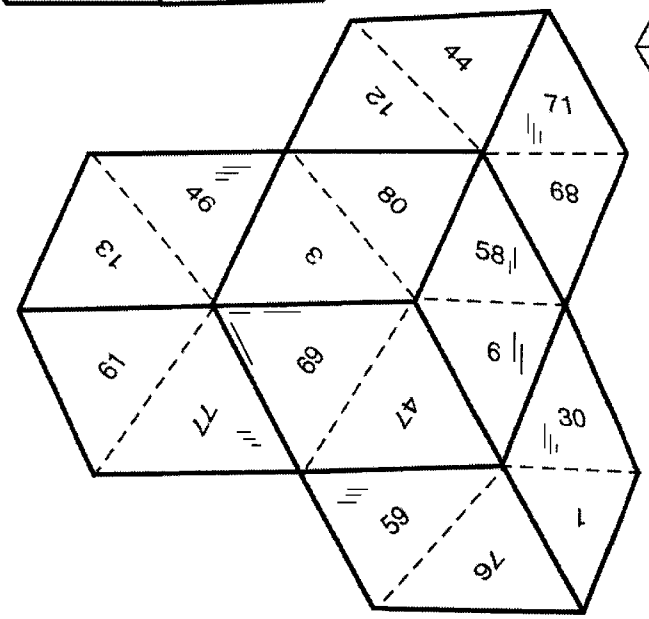
Figure 32C:
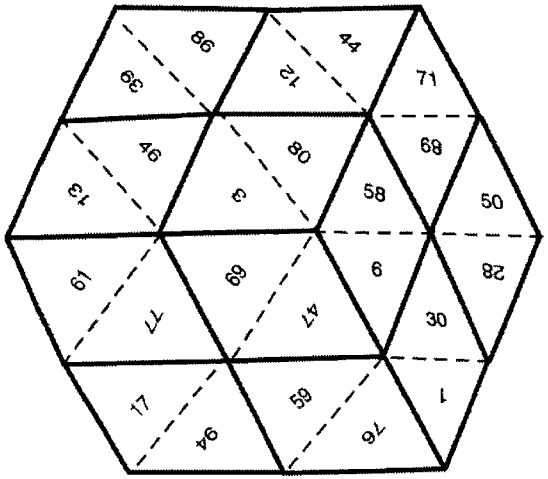
Figure 33A:
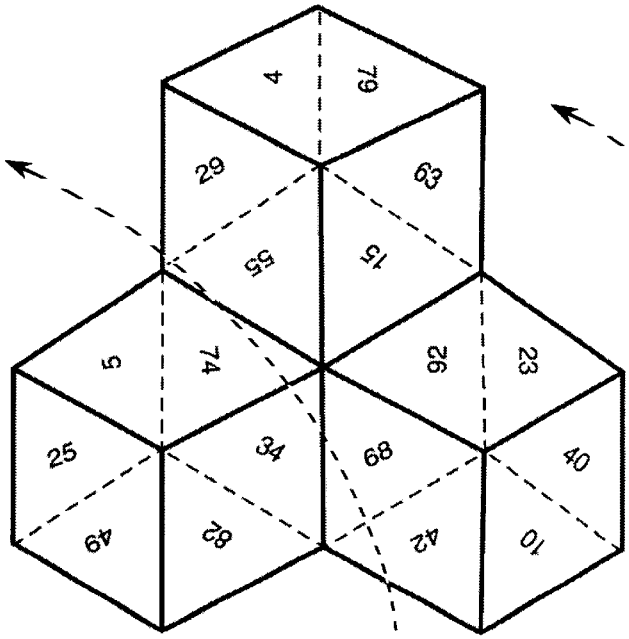
FIGS. 33A–33C are perspective views as in FIG. 32, showing two further Itrigons and the resulting obtuse rhombohedron shape formed thereby.
Figure 33B:
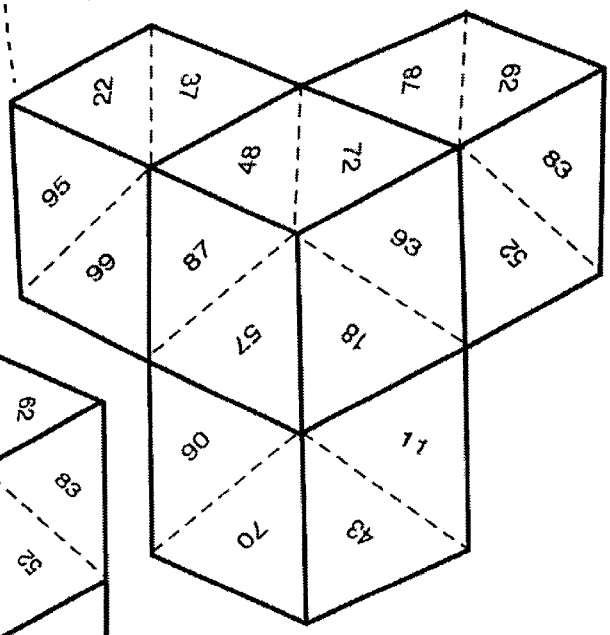
Figure 33C:
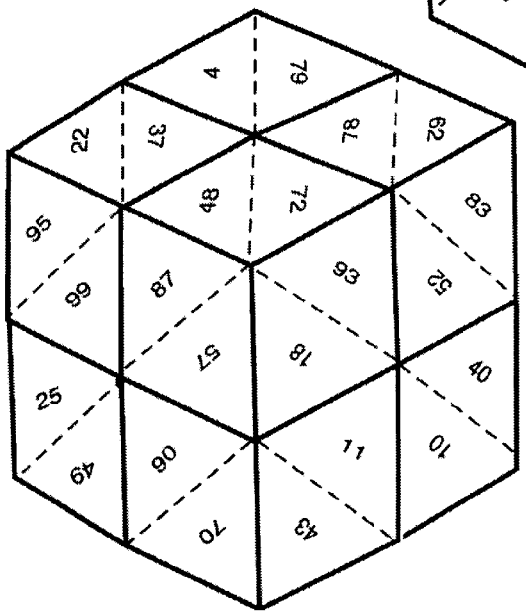
Figure 34A:
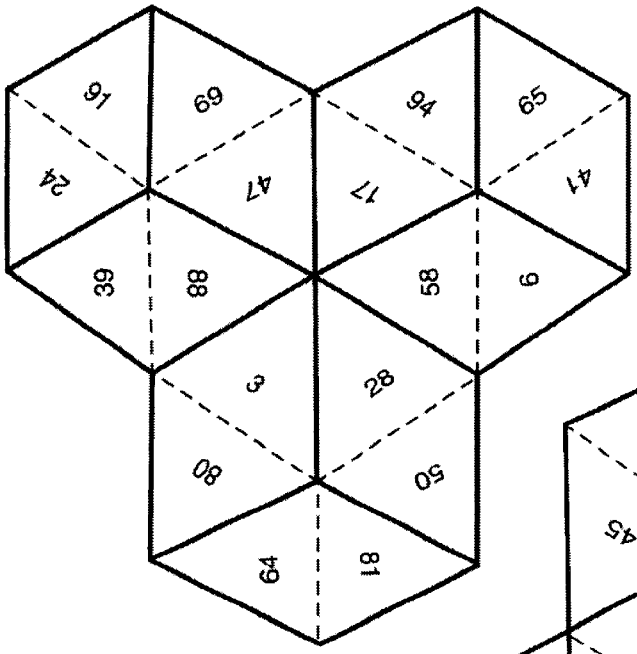
FIGS. 34A–34C are perspective views as in FIGS. 32 and 33, showing two further Itrigons and the resulting obtuse rhombohedron shape formed thereby.
Figure 34B:
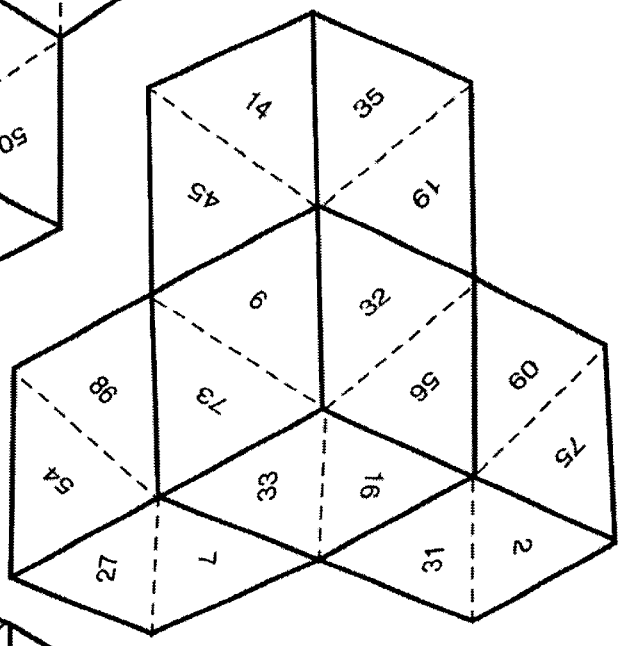
Figure 34C:
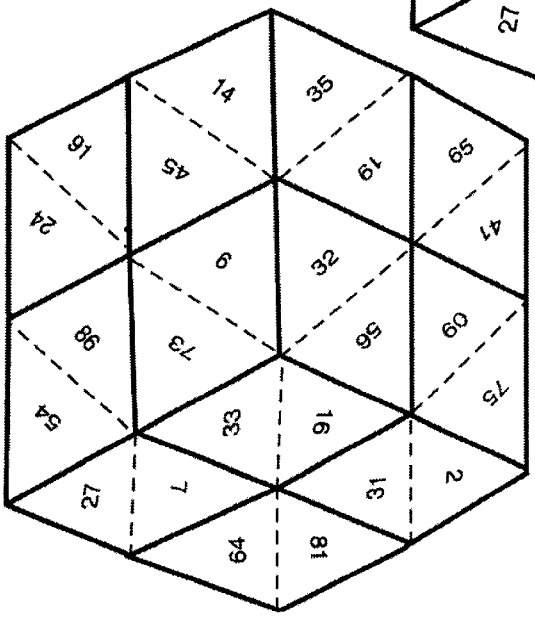
Figure 35A:
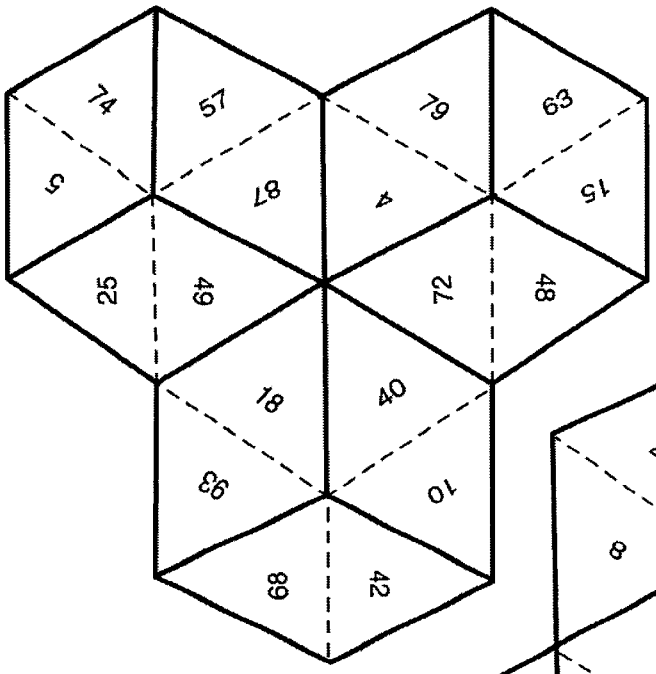
FIGS. 35A–35C are perspective views as in FIGS. 32–34, showing two further Itrigons and the resulting obtuse rhombohedron shape formed thereby.
Figure 35B:
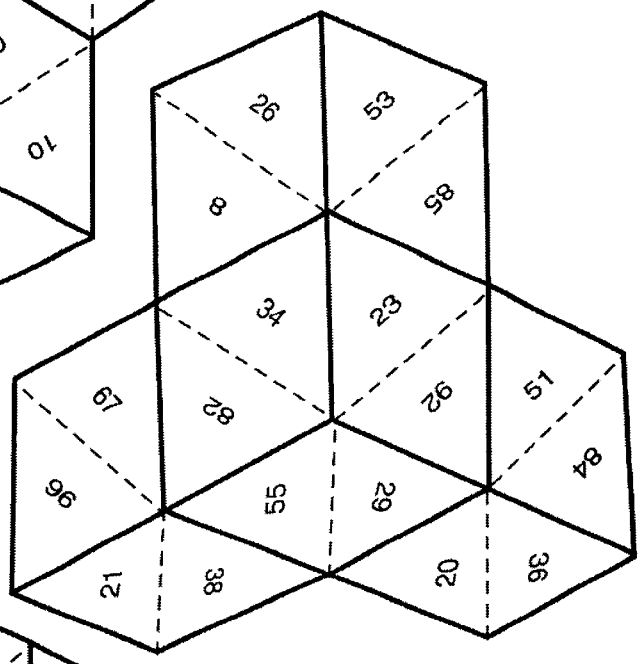
Figure 35C:
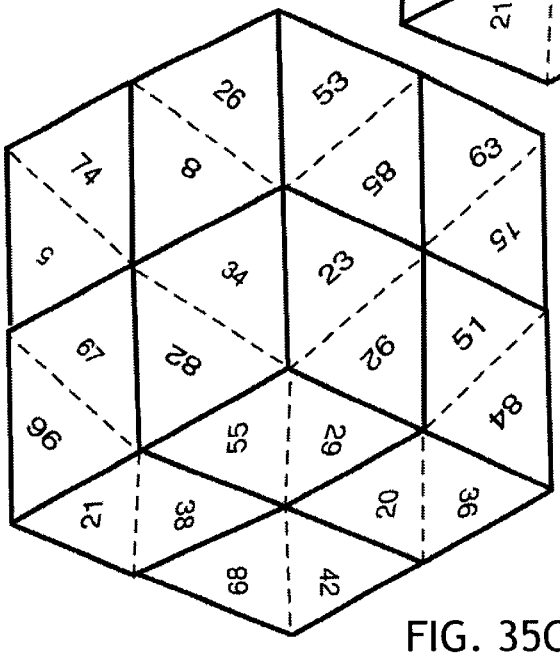

The invention also includes the concept of employing a plurality of 24 tetrahedron rings combined together to form a large number of different shapes. For example, a plurality of eight 24 tetrahedron rings with the same number indicia arrangement as shown in FIG. 9 can be used in combined form to make an even more complex puzzle. In this example, each of two tetrahedron rings of FIG. 9 may be formed into a trilobed, multi-rhombic shape, termed Itrigons, as shown in FIGS. 32A and 32B. These itrigons may then be combined to form an obtuse rhombohedron (a "skewed cube"), as shown in FIG. 32C. FIGS. 33–35 depict further configurations (different numbered facets exposed) of two paired itrigons and the resulting obtuse rhombohedrons. The four obtuse rhombohedrons thus formed (FIGS. 32C, 33C, 34C, and 35C) may then be combined to construct a two frequency rhombic dodecahedron as shown in FIG. 13. The technique for combining the obtuse rhombohedrons is shown in FIG. 14, and the resulting two frequency rhombic dodecahedron has 96 triangles displayed on the exterior thereof. With proper selection of the outer surfaces of the Itrigons and careful attention to assembly of the four obtuse rhombohedrons, each of the numbers from 1 to 96, without duplication, may be displayed on the exterior of the two frequency rhombic dodecahedron, resulting in a magic constant of 4656. This requires arranging the eight shapes without any gaps between them (1) so that they make a 2 frequency rhombic dodecahedron; and (2) so that no number is repeated on the surface. This task is in itself an engaging and laborious puzzle. This puzzle involves eight shapes that can be either (1) all the same, (2) two different kinds, or (3) all different kinds. Since this puzzle puts all the 96 faces of the 24 tetrahedron ring on a single exterior surface, the ultimate graphic embodiment would not necessarily have to involve numbers. One preferred embodiment would be a surface of ten colored rings going continuously over and under one another along different axes of the shape. Others could include representations of the surface of the earth, moon, or similar spheres.

Figure 15:
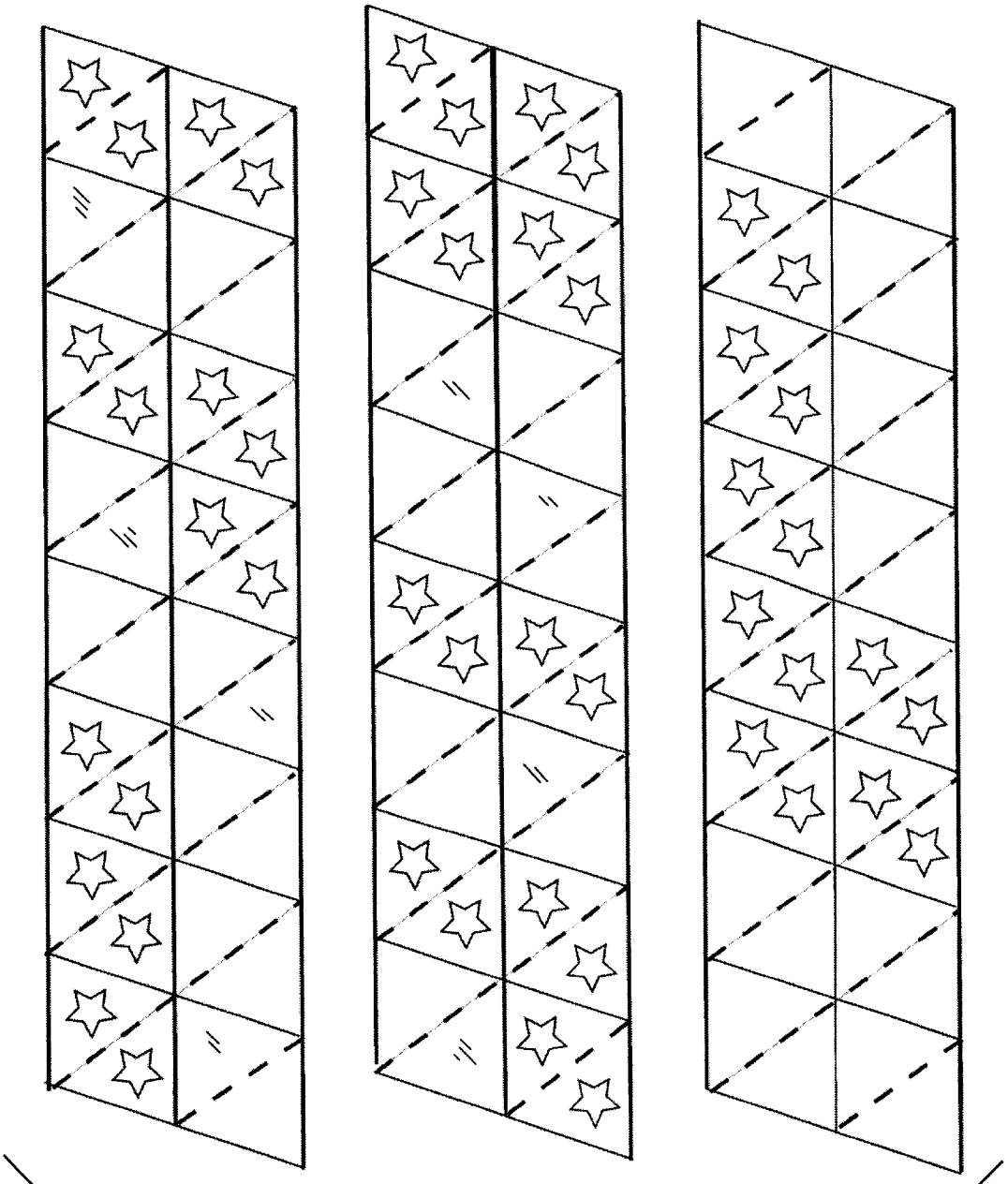
FIG. 15 is a plan view of a scored blank of sheet material, in which a pattern of star indicia is arranged.
Figure 16A:
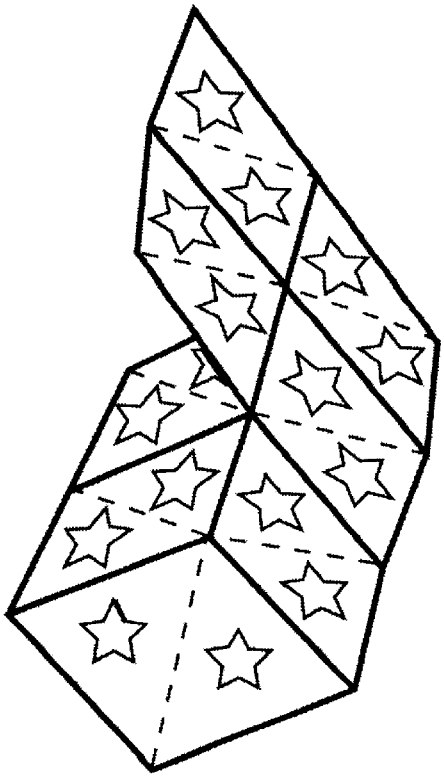
FIGS. 16A and 16B depicts the solution to the puzzle made from the folded sheet of FIG. 15, all exterior faces displaying star indicia.
Figure 16B:
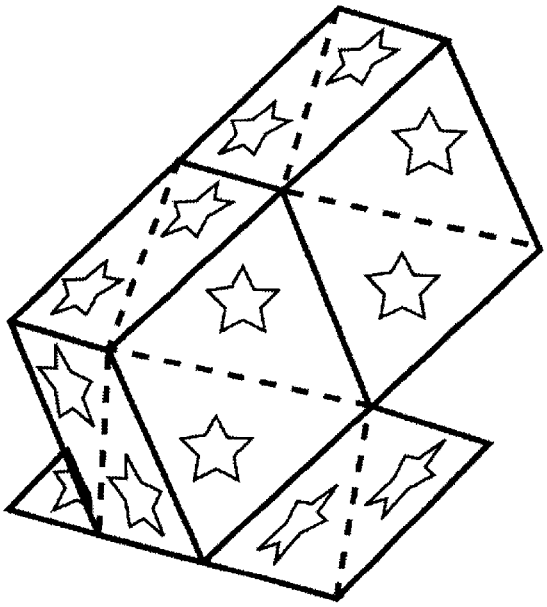

It is known that prior art puzzles with only one desired outcome, such as Rubik's "Amazing Folding Puzzle", are also popular. Puzzles of this sort relate a certain graphic design to a specific configuration of the puzzle; in the prior art this might consist of a configuration in which all the ring pieces on various panel members will form the desired outcome of an easily recognizable set of linked or non-linked rings. In another embodiment of the 24 tetrahedron ring several puzzles can be designed with two graphically different kinds of diamond faces on the tetrahedron ring in equal amounts (24 and 24). One such embodiment (FIG. 15) shows an arrangement of two kinds of diamond faces, one having star indicia and one having solid color (or no indicia). In this case, there are exactly two contracted shape solutions: one that displays only the star indicia on every face of the exterior surface (FIG. 16), and its mirror image which displays only solid faces with no indicia.

Figure 17A:
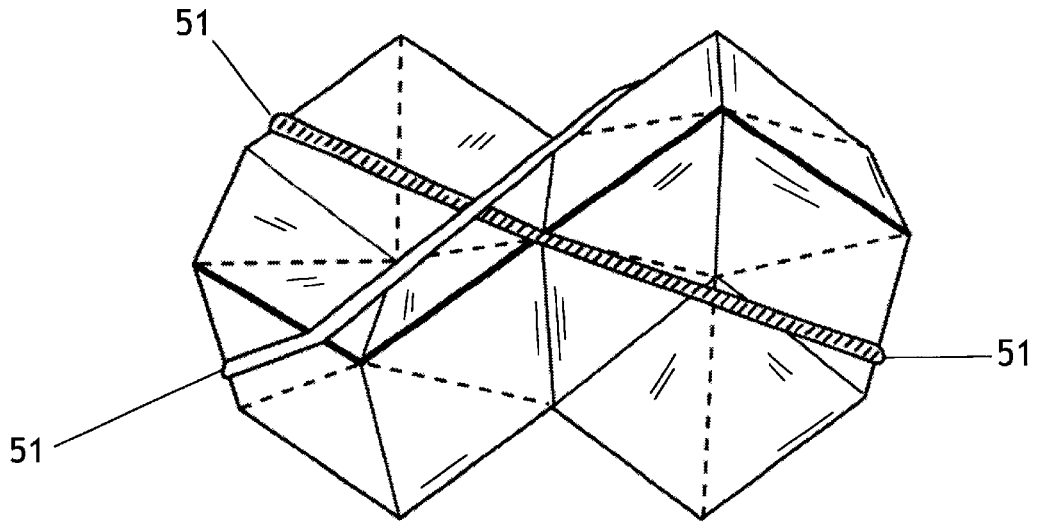
FIGS. 17A and 17B are side and top views showing rubber bands holding together a contracted shape formed by the tetrahedron ring of the invention.
Figure 17B:
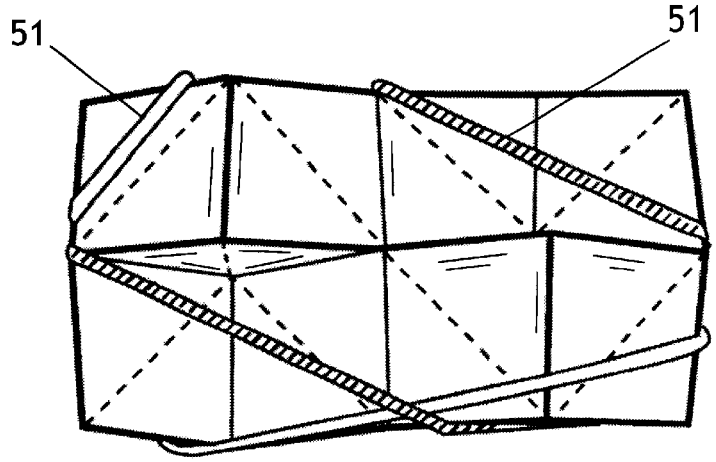

The invention further provides various arrangements for maintaining the tetrahedron ring in a desired configuration. As shown in FIGS. 17A and 17B, one arrangement for holding together contracted large tetrahedron rings can include at its simplest level one or more elastic bands 51. (The closed serpentine shape of FIG. 17 requires two bands.) In general more than one elastic band is required to fit around various diameters of the various sections of the ring. Nearly every kind of contracted shape can be held together by appropriate sized elastic bands, though in many cases some portion of the stretched elastic bands will not be in contact with the outer surface of the shape.

Figure 18B:
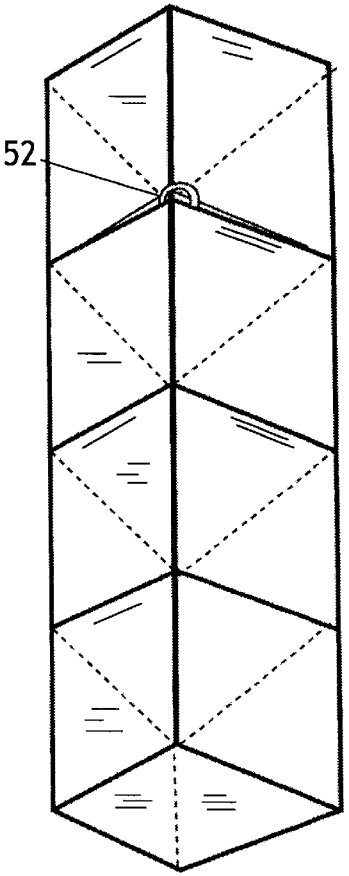
FIGS. 18A and 18B depict the two steps involved in installing a standard paper clip to hold together a contracted shape.
Figure 18A:
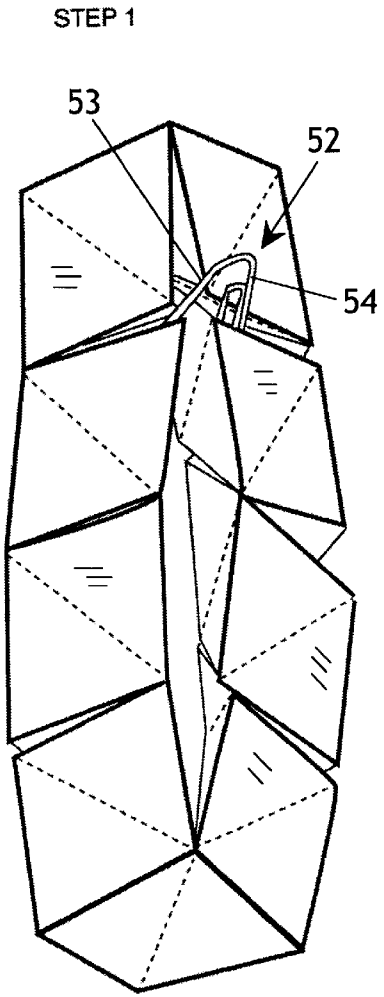

Another arrangement for maintaining a desired configuration of the tetrahedron ring involves the use of one or more paper clips; e.g., a standard wire paper clip having one and one-half loops in a common plane. With regard to FIG. 18A, an exemplary beam configuration may be secured with a single paper clip 52. At any point where the inner edges of two opposing hinges are in contact with one another, a paper clip may be installed to secured the two hinges in abutting relationship. The outer end 53 of the paper clip is bent outwardly from the body 54 of the clip and in the same common plane, and the body portion 54 is inserted into acutely folded portion of one hinge while the end 53 is inserted into the acutely folded portion of the adjacent impinging hinge. The clip 52 is then pushed fully into the hinge folds, as shown in FIG. 18B, so that the clip is unobtrusive. Some configurations of the tetrahedron ring, and shapes formed by combining a plurality of rings, require more than one paper clip to maintain the desired assembly.

Figure 19:
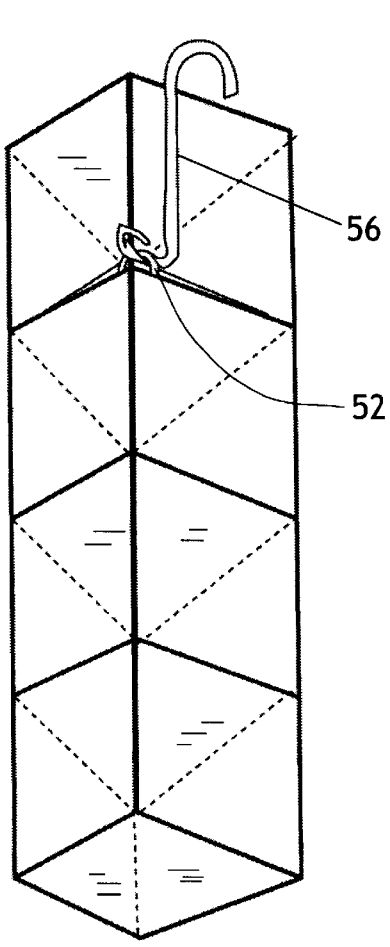
FIG. 19 is a perspective view as in FIG. 18B, showing a paper clip and hook arrangement construction for a hanging ornament suitable for Christmas trees.

With regard to FIG. 19, the friction connection of the paper clip 52 is of sufficient strength to allow for a hanging hook 56 to be slipped under its protruding loop. This arrangement forms an ornament suitable for hanging on a Christmas tree. Note that any configuration of the tetrahedron ring may be secured and hung as an ornament. Moreover, the design and indicia applied to the triangular faces may be harmonized with the ornamental use; i.e., a candy cane pattern or images of shiny ornamental balls may be provided for Christmas tree ornamental use.

As an alternative to the external devices for securing a tetrahedron ring in a desired configuration as described above, the invention provides various arrangements for releasably securing together impinging faces of the tetrahedron ring, whereby any constructed configuration is self-maintaining. A unique property of the tetrahedron ring, heretofore undiscovered, is that bipolar connector devices may be secured to the triangular faces of the tetrahedrons in a predetermined pattern that secures all possible contracted shape of the tetrahedron ring. With regard to FIG. 20, a layout similar to FIG. 9, each diamond face contain a "plus" triangle and a "minus" triangle in hinged, adjacent relationship and the plus and minus triangles are self-attracting. Also, each triangular facet having a "plus" connector is surrounded by adjacent triangular facets having "minus" connectors, and vice-versa. The realization of this arrangement in the fully constructed ring is shown in FIG. 21.

Figure 20:
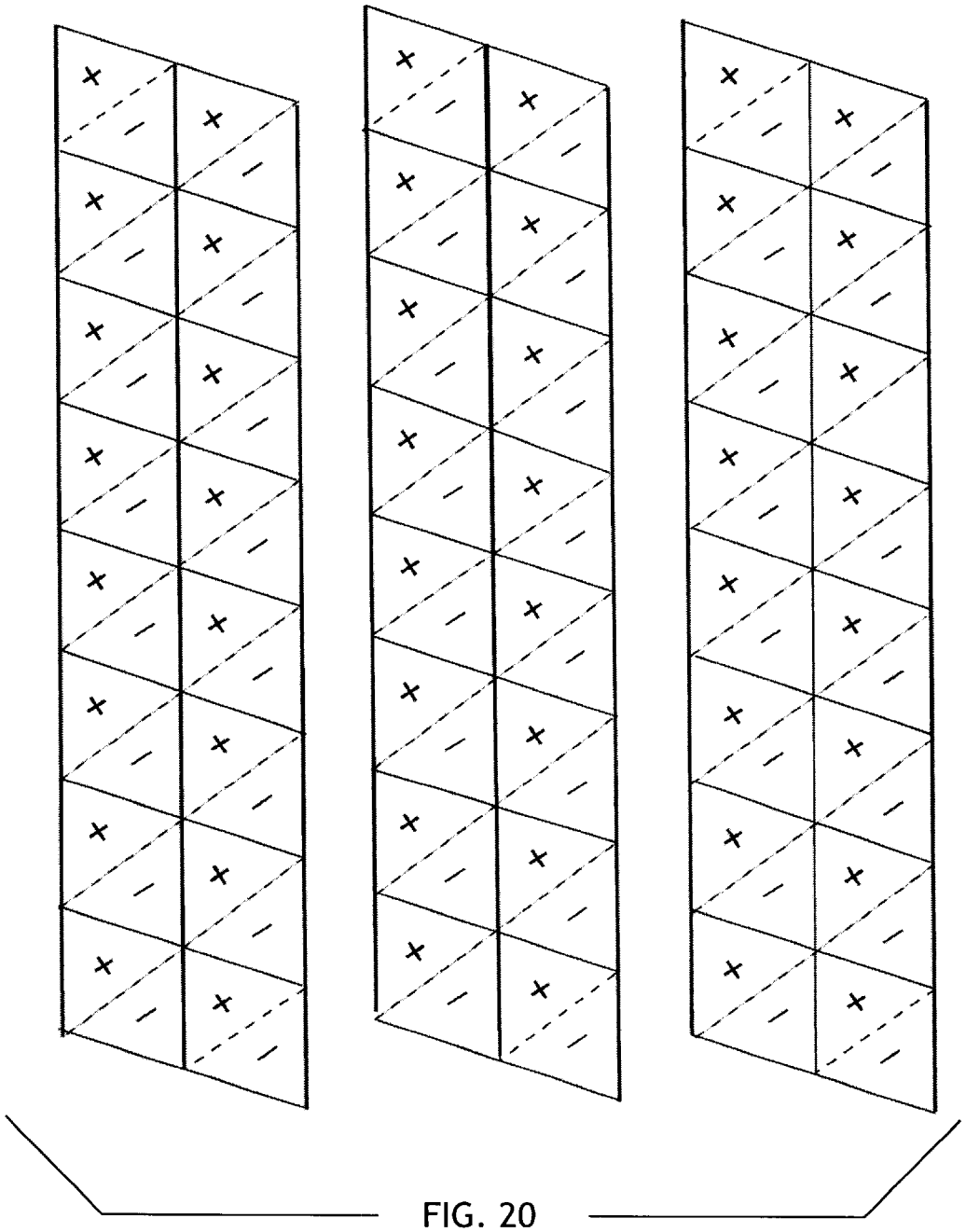
FIG. 20 is a plan view of a scored blank as in FIG. 9, showing a suitable arrangement of magnets, or any such two-part connecting system, including Velcro.
Figure 21:
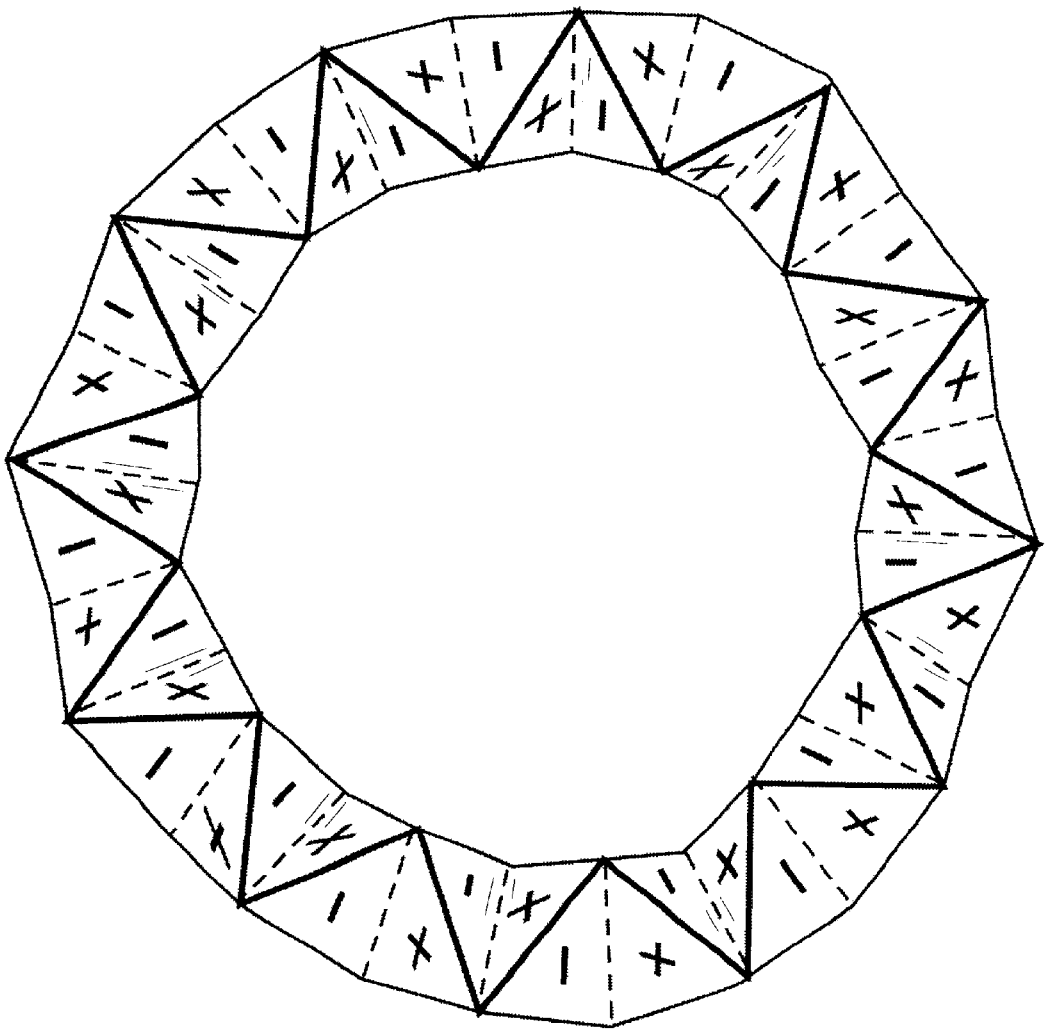
FIG. 21 depicts the spatial relationship of the opposed fasteners in the tetrahedron ring.

As one example, the pluses and minuses of FIGS. 20 and 21 may each represent a magnet embedded in a respective triangular face or secured behind the face within the tetrahedron, with the magnetic north and south poles corresponding to the plus and minus layout. (Obviously, north or south magnetic poles may be replaced as a group by a ferromagnetic material that is attracted to the opposite south or north magnetic poles, respectively.)

Figure 22:
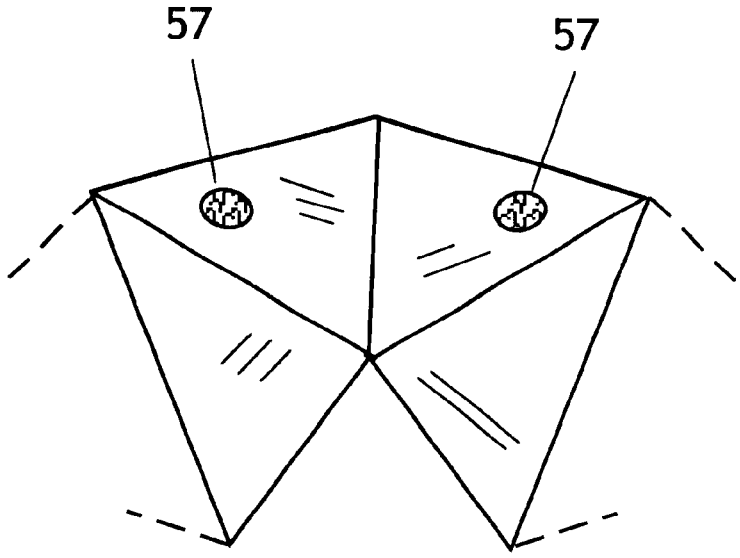
FIG. 22 shows how Velcro is arranged on the 24 tetrahedron ring in a plush toy design
Figure 23:
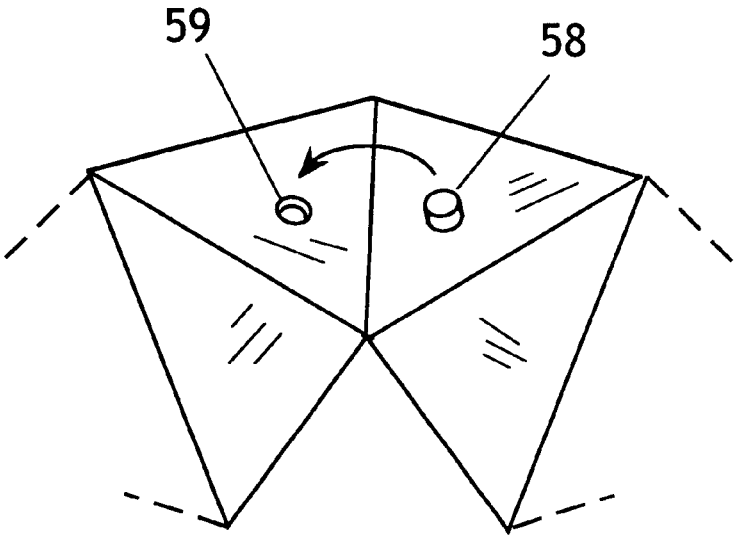
FIG. 23 shows how a protruding post and receiving hole might work with a similar bipolar arrangement.

Alternatively, as shown in FIG. 22, hook and loop fastener patches 57 may be used to releasably secure impinging triangular faces. In the case of Velcro material, the separate hook and loop portions correspond to the plus and minus layout. Other hook and loop fastener systems, such as DuoLock by 3M Corp., are one-part systems in which any patch will adhere to any other patch, and the plus and minus arrangement is irrelevant. In another alternative, shown in FIG. 23, posts and receptacles may be provided in the same plus and minus layout, with each post 58 placed to be received and releasably retained by the respective receptacle 59 in the adjacent face. In all the examples of FIGS. 20–23, the fasteners are placed in a regular and reiterated manner throughout the ring. In addition, more than one fastener of the same or different type may be provided on each triangular face.

Figure 24:
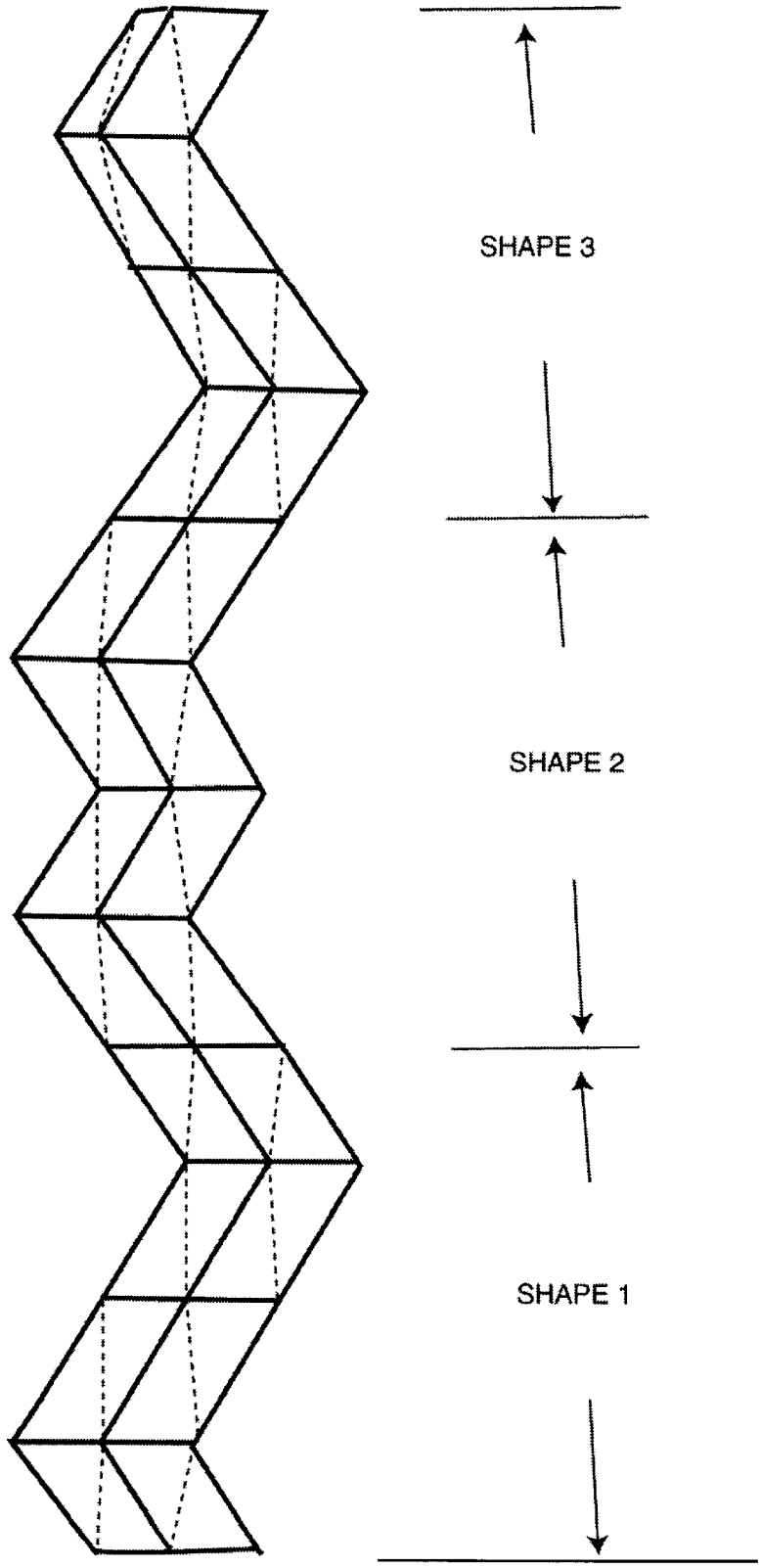
FIG. 24 depicts a tower construction arrangement involving three tetrahedron rings.

Since the shapes formed by a single tetrahedron ring in many cases have a variety of parallel faces, they can be attached to one another in a multitude of arrangements. With regard to FIG. 24, one such pleasing arrangement shows how three shapes, each formed of a single tetrahedron ring, may be attached to one another to form a balanced, self-supporting zig/zag tower, using any of the fastener arrangements described previously. This composite shape exhibits an exciting advantage over the prior art, where vertical, weight supporting structures are generally perpendicularly arranged.

It is another significant feature of this invention that it can be made in a plurality of sizes from the very small to the very large. For easily manipulatable puzzle projects requiring some manual dexterity, the preferred range of the isosceles edges of the triangles could be from ½ to 3 inches, but certainly not limited to these dimensions. In an embodiment in which the ring may be contracted into a large beach ball or plush toy play ball, edges of four inches or larger could easily be employed. Still larger variations with architectural or even space station potential that would take advantage of the interior volume of the tetrahedrons is not meant to be excluded.

Figure 25:
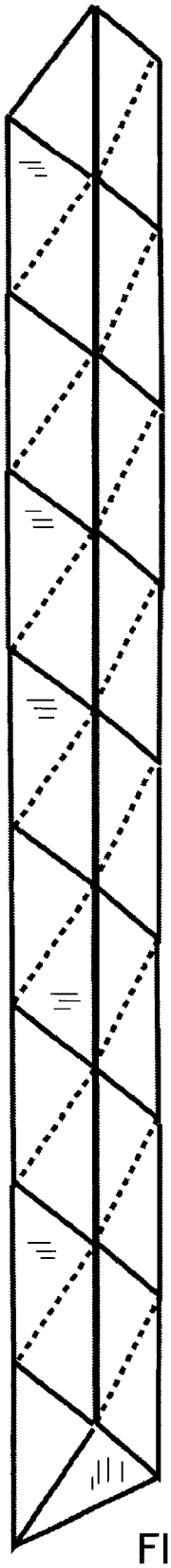
FIG. 25 depicts a side view of a triangular prismatic shape made from an "open" 24 tetrahedron chain.

The invention also includes versions in which the ring is open at one hinge position such that the 24 tetrahedrons are joined by 23 hinges instead of 24. This chain version has the potential for making, in addition to all the contracted shapes made by the closed ring, a set of shapes based on triangular prismatic structures. In one such shape, shown in FIG. 25, each side of the triangular prism would display eight adjacent diamond faces.

Figure 26:
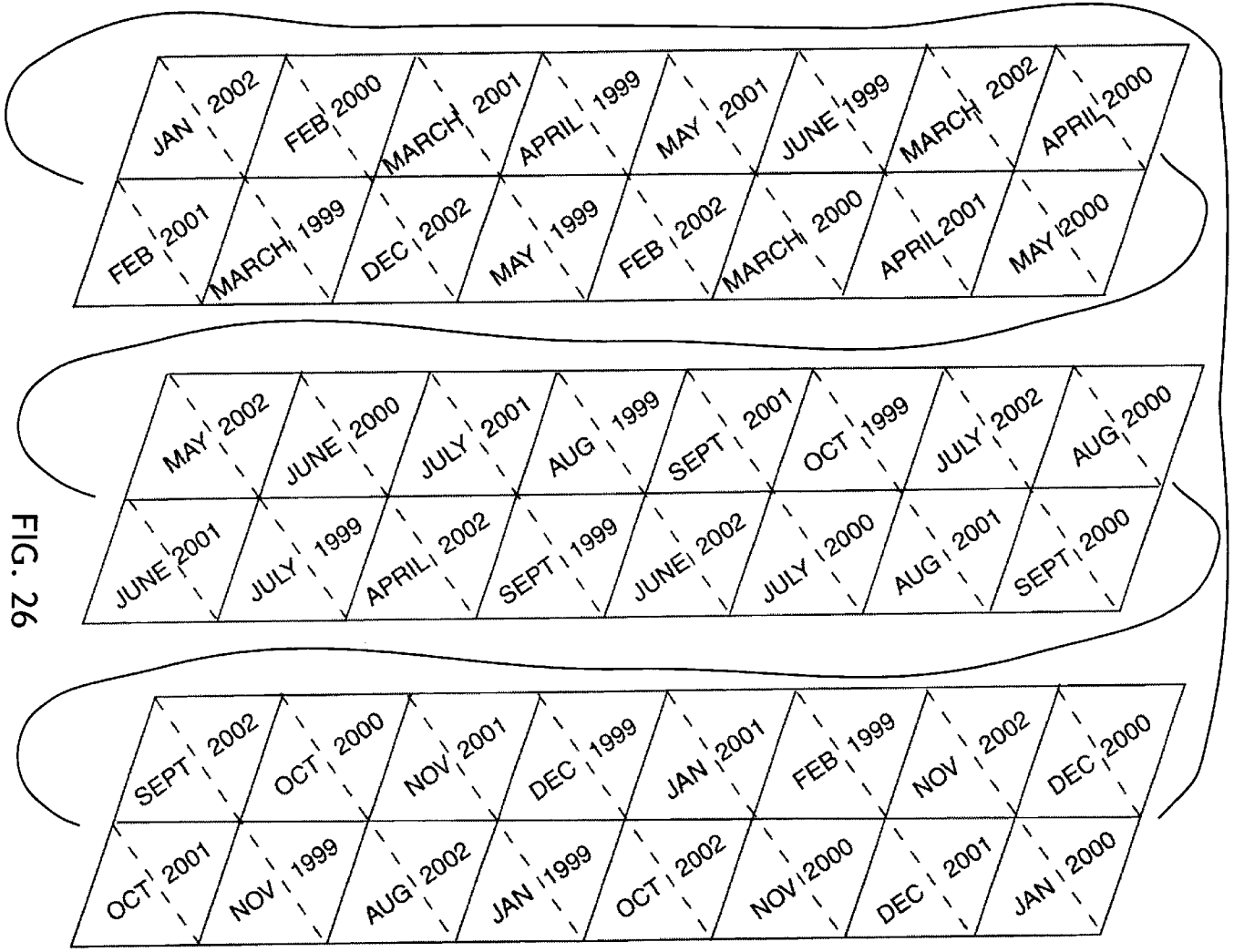
FIG. 26 is a further embodiment of plan view of a scored blank of sheet material, bearing a predetermined calendar arrangement in which the 48 months for the years, 1999, 2000, 2001 and 2002 are displayed.
Figure 27:
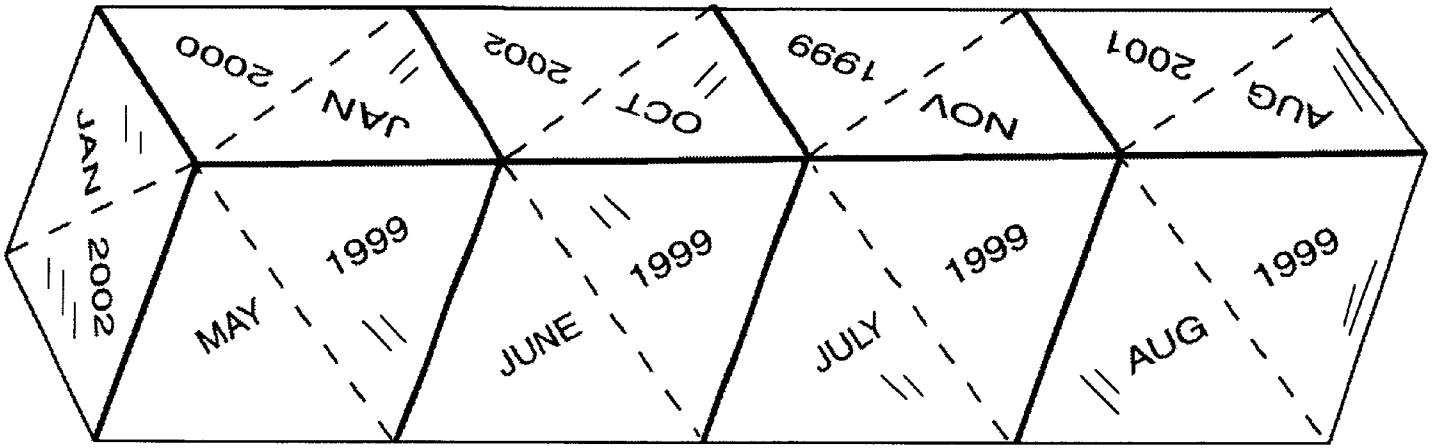
FIG. 27 is a perspective view of a beam shape formed of the 24 tetrahedron ring comprised of the blank sheet of FIG. 26.

With regard to FIG. 26, a further embodiment of graphic indicia applied to the outer surfaces of the tetrahedron ring includes a predetermined arrangement of the months of four consecutive years, such as 1999–2002, each month displayed including all the days of that month (not shown). As shown in FIG. 27, the tetrahedron ring formed of the scored blank of FIG. 26 may be configured into a beam shape that exhibits four consecutive months of the same hear in adjacent positions along the beam. This configuration may be altered every four months to provide an ongoing, four year calendar display and an ongoing puzzle that must be "solved" reiteratively. The ring may be formed of materials suitable for a desktop ornament.

Figure 28:
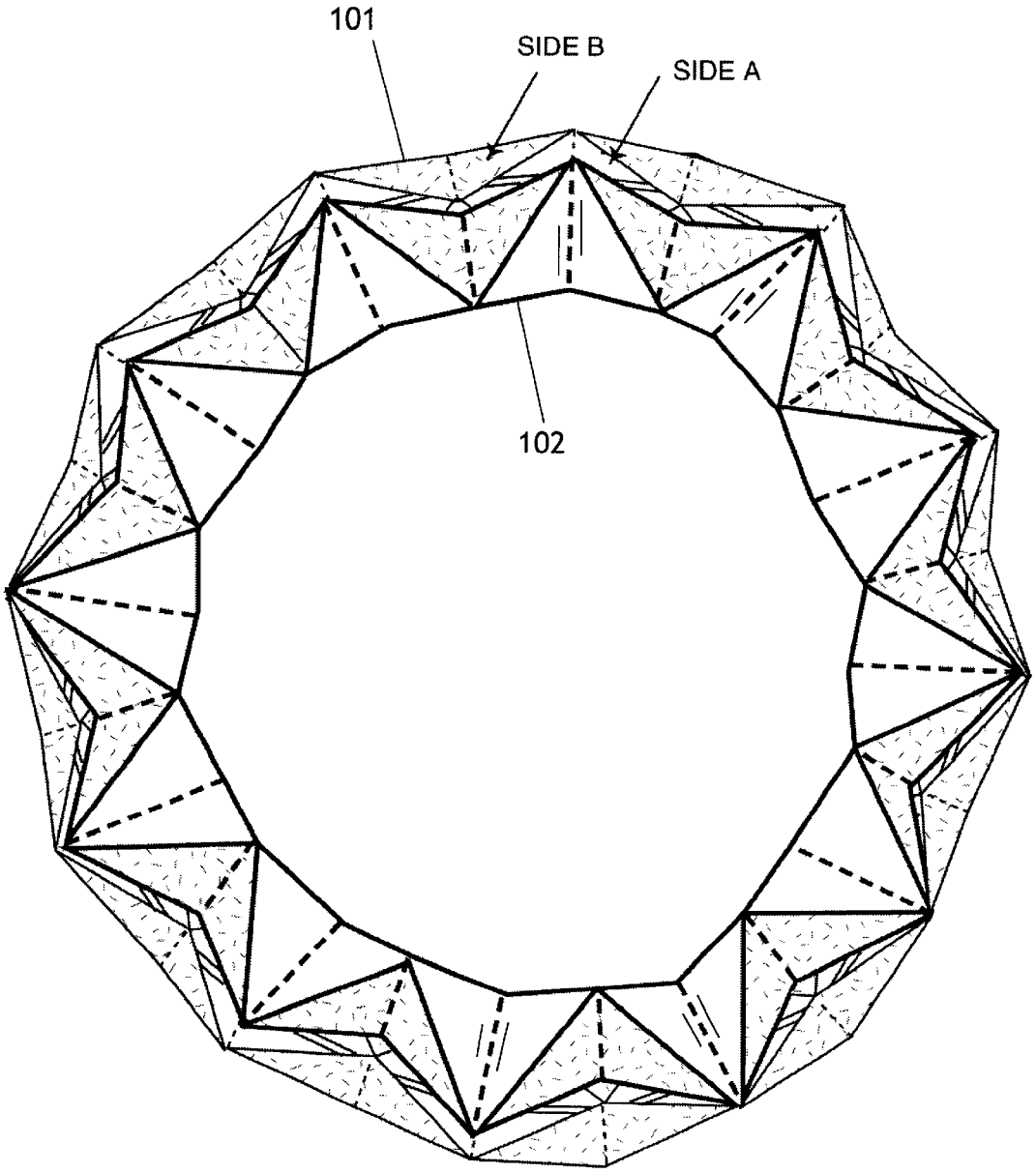
FIG. 28 is a top perspective view showing two rings formed of 24 tetrahedrons each and defined as the product of bisecting along the connection axis the single ring of 24 tetrahedrons shown in FIG. 1.
Figure 29A:
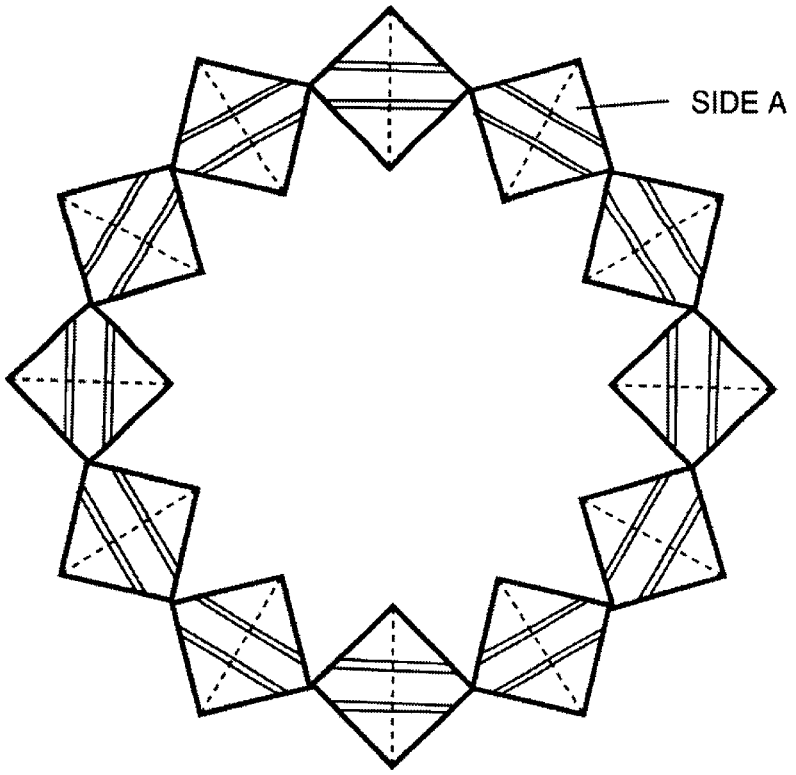
FIGS. 29A and 29B are a top view and a slightly rotated top view, respectively, of one of the two tetrahedron ring of FIG. 28, showing the opposed sides A and B.
Figure 29B:
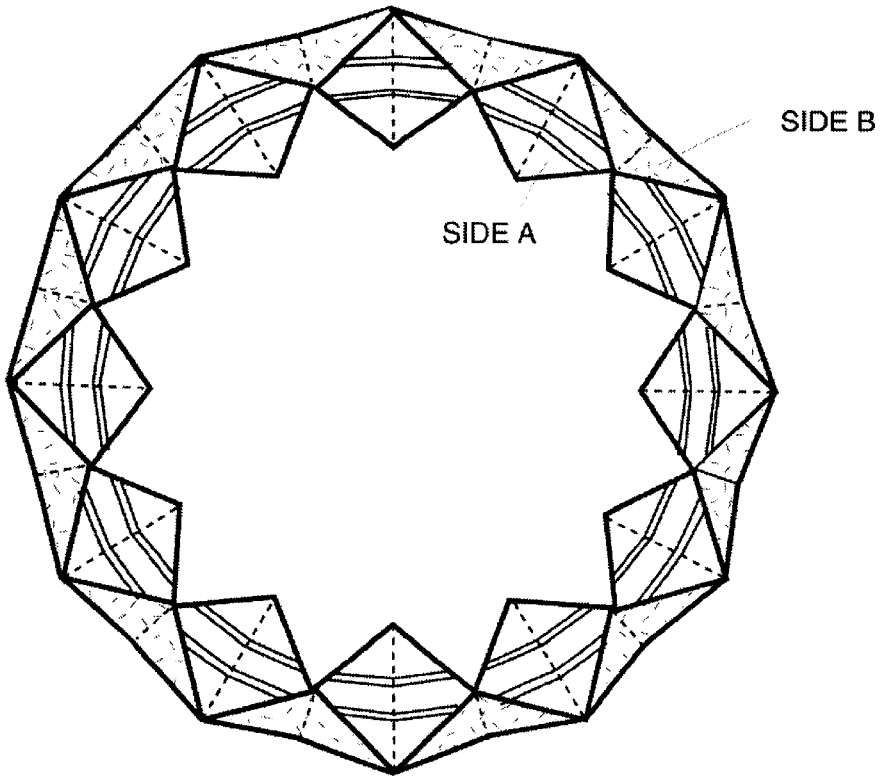

With regard to FIG. 28, a further embodiment of the invention includes a pair of tetrahedron rings 101 and 102 formed of 24 tetrahedrons in a closed. hinged loop. The rings 101 and 102 are defined as the product formed by bisecting a single isosceles tetrahedron ring along a plane that extends through the axis of the closed loop. The tetrahedrons in each ring are defined by four triangular faces: two right triangles, each having acute angles of approximately 54.74° and 35.26°, an isosceles triangle of approximately 70.53° and 54.74°, and an isosceles right triangle. These triangular faces and their relationships are viewed also in FIG. 29.

Figure 30:
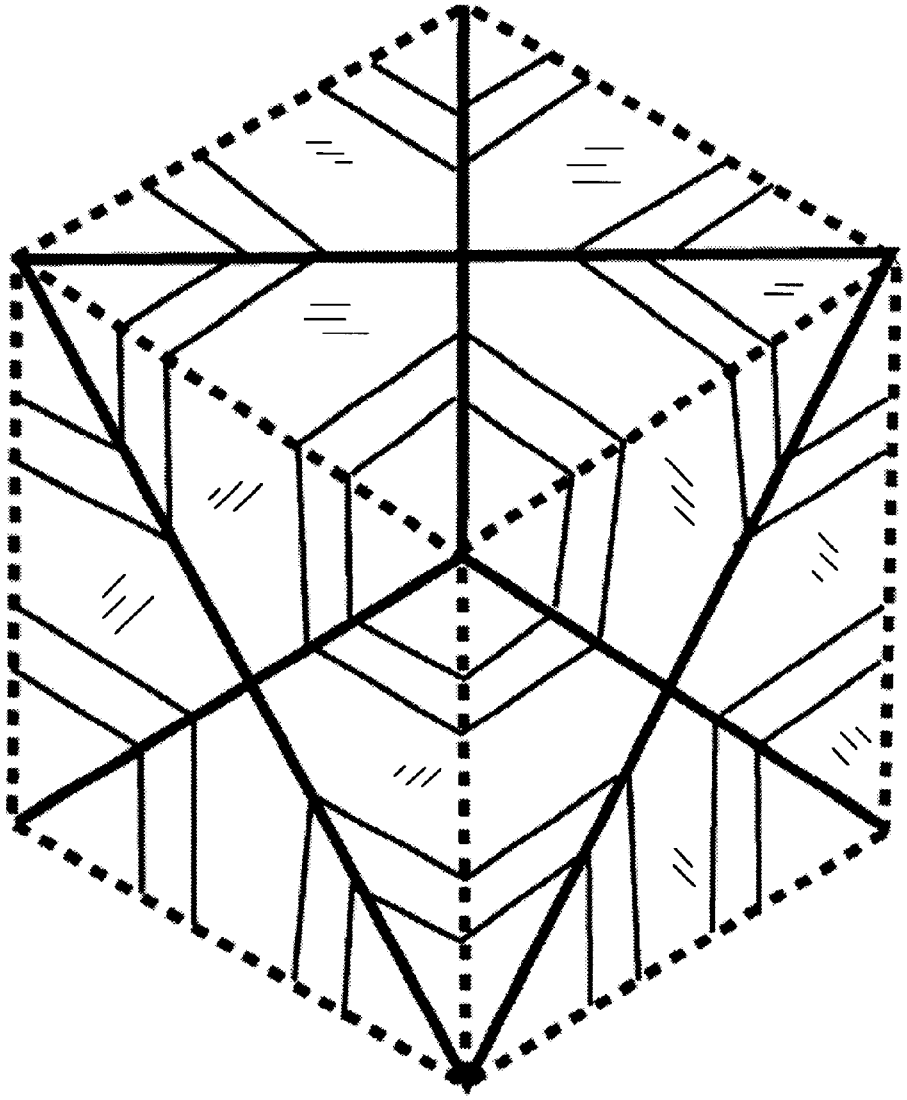
FIG. 30 is a perspective view of a cube formed by the tetrahedron ring depicted in FIG. 29.
Figure 31:
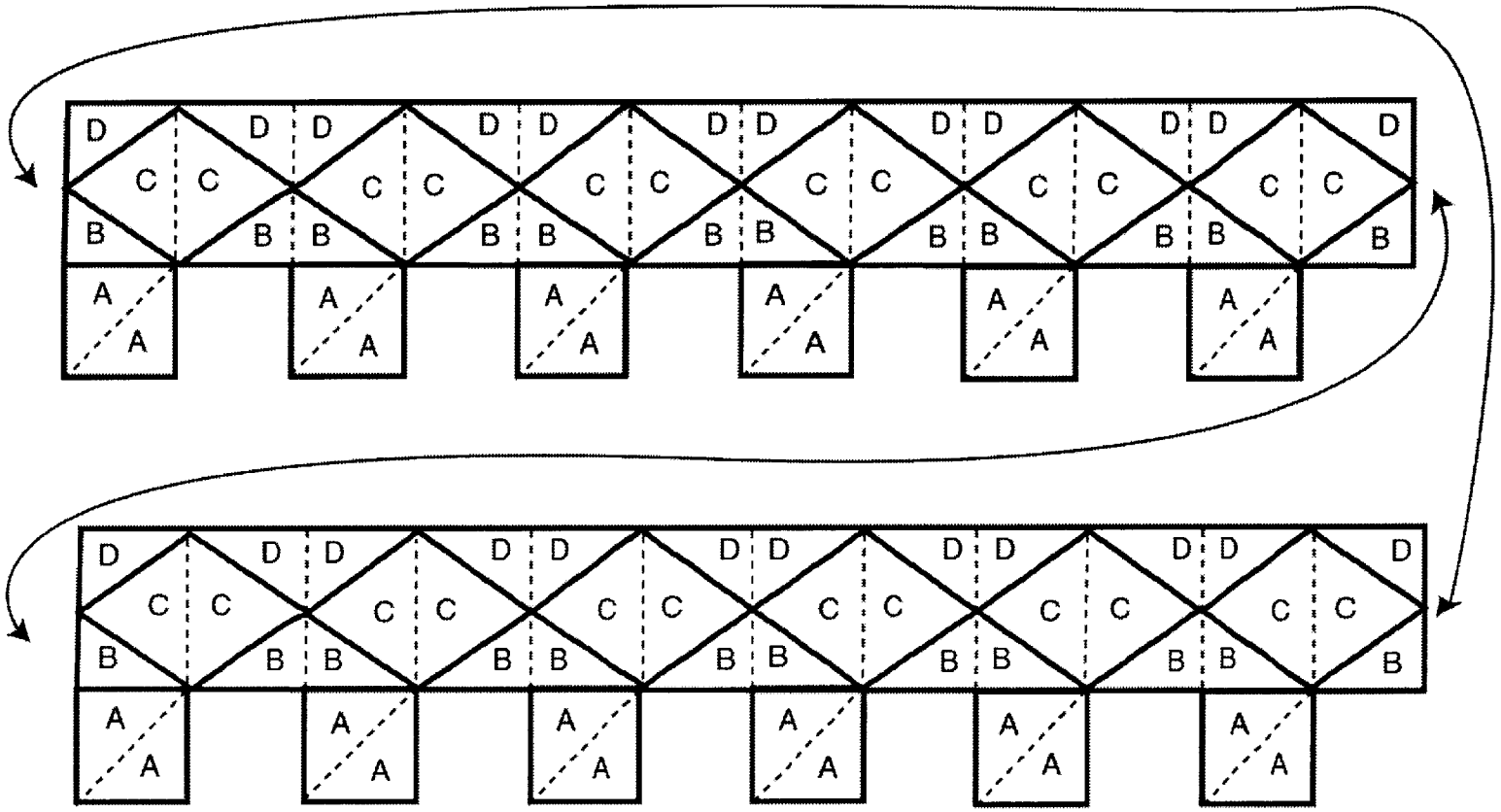
FIG. 31 is a plan view of a scored blank of sheet material scored to form a tetrahedron ring as shown in FIGS. 29 and 30, with a four color pattern denoted by letters A, B, C, and D included in the facets.

The two rings 101 and 102 may be disposed in paired, enantiomorphic relationship, whereby there is available all of the various shapes and properties of the tetrahedron ring described previously. In addition, one of the rings 101 or 102 may be manipulated to form an additional range of shapes. For example, a ring of FIG. 29 may be folded to form a cube, as in FIG. 30, a shape that is not attainable with one tetrahedron ring of isosceles tetrahedrons. The rings 101 and 102 may be provided with superficial patterns or colors as shown in an arrangement shown in FIG. 31, whereby a cube such as shown in FIG. 30 may exhibit a common pattern or color on all exterior surfaces. It may be noted that the rings 101 and 102 are identical in construction, but in order to have all four colors of the ball represented, one ring would have a further color E substituted for each of the triangle faces labeled C. Many other shapes may be fashioned, and various surface patterns and indicia may be applied to create visual interest, increase the puzzle difficulty, or exhibit advertising and logo images.

It should also be noted that preferred embodiments should not be limited to having all four faces of each tetrahedron of the 24 tetrahedron ring being of a solid material. A tetrahedron is structurally sound with only three faces, so one face can be removed from each tetrahedron without losing the shape and structure of the invention. This embodiment opens up further graphic possibilities because it makes 144 triangles visible on the surface of the shape, rather than 96.

It is noted that the indicia presented on the various faces of the tetrahedron constructions may be devoted to other uses. For example, each of the 48 facets may present a picture of a member of a sports team. One (American) football team having 45 players and three coaches may be represented in its entirety, or four basketball teams or hockey teams, or the like. Such presentations may comprise sports memorabilia for particular contests, or team personnel, and may be purchased by sports fans. Alternatively, the facets may be provided with figures that form a tessellated plane, in accordance with the concepts of M. C. Escher, Roger Penrose, and John Osborne. The figures may be filled with color or patterns and arranged on the facets so that they are combined into whole contiguous figures of common color or pattern whenever the tetrahedrons are contracted into the dodecahedron ball or other configurations such as those disclosed herein.

Each tetrahedron in the ring or chain is a hollow object, and is capable of being filled with a substance or material having useful applications. For example, in the plush toy example given above, the tetrahedrons may be filled with soft foam material. Other filling substances include spices, fragrant materials such as potpourri or individual fragrant substances in each tetrahedron, herbs, flower seeds, hard candies, beads, nuts and screws, nails and brads, electronic components, or any collection of small objects. Each tetrahedron may be provided with an opening to gain access to its contents, and the opening may be resealable by any means known in the prior art. The fact that the tetrahedrons may be contracted into an all-space filling ball provides compact and efficient storage, while the ease of access to any of the tetrahedrons in the expanded ring or chain provides convenient access to any selected tetrahedron and its contents.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. A transformational puzzle construction, including:

24 tetrahedron bodies, said bodies being substantially identical in size and configuration;

said tetrahedron bodies being all-space filling tetrahedrons;

said tetrahedron bodies being isosceles tetrahedrons; hinge means for joining said tetrahedron bodies in a closed loop configuration with pivoting connections between adjacent tetrahedron bodies in said closed loop configuration to facilitate the formation of a plurality of complex and simple geometric shapes.

2. A transformational magic number puzzle construction, including:

24 tetrahedron bodies, said bodies being substantially identical in size and configuration;

said tetrahedron bodies being all-space filling tetrahedrons;

said tetrahedron bodies being isosceles tetrahedrons:

hinge means for joining said tetrahedron bodies in a closed loop configuration with pivoting connections between adjacent tetrahedron bodies in said closed loop configuration to facilitate the formation of a plurality of complex and simple geometric shapes;

further including numerical indicia applied in a predetermined pattern to the exterior surfaces of the triangular facets of said tetrahedron bodies, said predetermined pattern yielding a magic number sum for all exposed numerical indicia for a plurality of solid shapes formed by said tetrahedron bodies.

3. A transformational puzzle construction, including:

24 tetrahedron bodies, said bodies being substantially identical in size and configuration;

said tetrahedron bodies being all-space filling tetrahedrons;

said tetrahedron bodies being isosceles tetrahedrons:

hinge means for joining said tetrahedron bodies in a closed loop configuration with pivoting connections between adjacent tetrahedron bodies in said closed loopconfigurationn to facilitate the formation of a plurality of complex and simple geometric shapes;

means for securing said tetrahedron bodies in any of said geometric shapes, including a plurality of bipolar connector devices secured to the triangular faces of the tetrahedrons in a predetermined pattern, said predetermined pattern enabling all contracted shapes of said tetrahedron ring to be secured by mutual engagement of said bipolar connector devices at all confronting, impinging triangular faces.

4. A tranformational calendar display, including:

24 tetrahedron bodies, said bodies being substantially identical in size and configuration;

said tetrahedron bodies being all-space filling tetrahedrons;

said tetrahedron bodies being isosceles tetrahedrons:

hinge means for joining said tetrahedron bodies in a closed loop configuration with pivoting connections between adjacent tetrahedron bodies in said closed loop configuration to facilitate the formation of a plurality of complex and simple geometric shapes, including a plurality of distinct contracted configurations each displaying an outer surface comprised of one of the four triangular facets of each of the tetrahedron bodies;

calendar portions applied in a predetermined pattern to the exterior surfaces of the triangular facets of said tetrahedron bodies, said calendar portions being distributed among said facets so that each of said distinct contracted shapes exhibits an exclusive calendar display for each of said distinct contracted configurations; and, means for securing said tetrahedron bodies in any of said distinct contracted shapes.

5. A tranformational puzzle construction, including:

a plurality of closed loops of tetrahedral bodies, each loop including 24 tetrahedron bodies, said bodies being substantially identical in size and configuration;

said tetrahedron bodies being all-space filling tetrahedrons;

said tetrahedron bodies being isosceles tetrahedrons:

hinge means for joining said tetrahedron bodies in a closed loop configuration with pivoting connections between adjacent tetrahedron bodies in said closed loop configuration to facilitate the formation of a plurality of complex and simple geometric shapes;

each of said closed loops including graphic representations applied in a predetermined pattern to the exterior surfaces of each of the 96 triangular facets of said tetrahedron bodies, each of said triangular facets having a unique outer appearance;

said plurality of closed loops being foldable and rotatable to form together a plurality of larger geometric shapes, at least one of said larger geometric shapes comprising a contracted solid having an outer surface in which each of said 96 triangular facets appears once without duplication.

6. The transformational puzzle toy of claim 1, wherein said geometric shapes includes a rhombic dodecahedron ball , said closed loop configuration permitting four distinct configurations that define said rhombic dodecahedron ball.

7. The transformational puzzle toy of claim 6, further including superficial imagery applied in a predetermined pattern to the exterior surfaces of the triangular facets of said tetrahedron bodies, said predetermined pattern yielding an exclusive exterior appearance for each of the four distinct tetrahedron configurations that may form a rhombic dodecahedron ball.

8. The transformational puzzle toy of claim 6, further including numerical indicia applied in a predetermined pattern to the exterior surfaces of the triangular facets of said tetrahedron bodies, said predetermined pattern yielding a magic number sum for all exposed numerical indicia for each of the four distinct tetrahedron configurations that may form a rhombic dodecahedron ball.

9. The transformational puzzle toy of claim 2, wherein said numerical indicia range from (1+n) to (96+n).

10. The transformational puzzle toy of claim 9, wherein said magic number sum is 1164+24n.

11. The transformational puzzle toy of claim 8, wherein said predetermined pattern of numerical indicia yields a plurality of magic shapes, each magic shape having a magic number sum for all exposed numerical indicia for each of the distinct tetrahedron ring configurations that may form the magic shape.

12. The transformational puzzle toy of claim 3, wherein said bipolar connector devices includes hook and loop fastener patches secured to each of the triangular faces of said tetrahedron bodies and disposed to engage other impinging fastener patches.

13. The transformational puzzle toy of claim 3, wherein said bipolar connector devices includes a plurality of magnets secured to each of the triangular faces of said tetrahedron bodies in a predetermined pattern of north and south poles, said pattern enabling all contracted shapes of said tetrahedron ring to be secured by mutual attraction of said plurality of magnets.

14. The transformational puzzle toy of claim 3, wherein said bipolar connector devices includes a plurality of posts and a plurality of receptacles arrayed in paired, frictionally engaging relationship, each paired post and receptacle secured in adjacent triangular faces of said hinged tetrahedral bodies.

15. The transformational calendar display toy of claim 4, wherein said means for securing includes at least one elastic band dimensioned to extend about said geometric shapes and retain said geometric shape.

16. The transformational calendar display of claim 4, wherein said means for securing includes at least one paper clip, said paper clip having a body portion extended into one acutely folded pivoting connection between two of said tetrehedron bodies, said paper clip having a distal free end extended into another acutely folded pivoting connection between two tetrahedron bodies, said one and another acutely folded pivoting connection being in substantially impinging relationship.

17. The transformational puzzle toy of claim 2, wherein said hinge means includes a pivoting connection extending between the longest edges of serially adjacent tetrahedron bodies in said chain configuration.

18. The transformational magic number puzzle toy of claim 2, wherein each of said isosceles tetrahedron bodies is composed of triangular faces having angles of approximately 70.53°, 54.74°, and 54.74°.

19. The transformational puzzle toy of claim 2, wherein said tetrahedron bodies are composed of one isosceles triangular face, one isosceles right triangular face, and two right triangular faces.

20. The transformational puzzle toy of claim 19, wherein said isosceles triangle includes interior angles of approximately 70.53° and 54.74°.

21. The transformational puzzle toy of claim 19, wherein said right triangles include interior angles of approximately 54.47° and 35.26°.

22. The transformational puzzle toy of claim 8, further including a plurality of said closed loops of tetrahedral bodies, each closed loop including said numerical indicia applied in said predetermined pattern, said plurality of closed loops being foldable and rotatable to form a plurality of larger geometric shapes.

23. The transformational puzzle toy of claim 5, wherein each of said plurality of closed loops is configured to form an Itrigon shape, and said Itrigon shapes are combined to form a two frequency rhombic dodecahedron.

24. The transformational puzzle toy of claim 7, wherein said superficial imagery includes one month calendar layouts for 48 consecutive months, each one month layout extending on two adjacent, hinged triangular faces of said tetrahedron bodies, said exclusive exterior appearance comprising twelve consecutive months.

25. The transformational puzzle toy of claim 4, wherein said superficial imagery includes one month calendar layouts for 48 consecutive months, each one month layout extending on two adjacent, hinged triangular faces of said tetrahedron bodies, said exclusive exterior appearance comprising four adjacent consecutive months.

26. The transformational puzzle toy of claim 2, wherein said hinge means includes a live hinge integrally molded with said tetrahedron bodies.

27. The transformational puzzle toy of claim 2, wherein said hinge means includes a plurality of hinges, each secured between confronting edge portions of serially adjacent tetrahedron bodies in said closed loop.

28. The transformational puzzle toy of claim 2, wherein said hinge means includes a web secured to the exterior surfaces of the triangular faces of said tetrahedron bodies and extending between confronting edge portions of serially adjacent tetrahedron bodies in said closed loop.

29. The transformational puzzle toy of claim 28, wherein said web includes superficial imagery applied in a predetermined pattern to said faces to yield a preferred exterior appearance for at least one of said geometric shapes.

30. The transformational calender display of claim 4, wherein said calender portions comprise one month calender layouts for 48 consecutive months each one month layout extending on two adjacent, hinged triangular facets of said tetrahedron bodies, each of said exclusive calender displays comprising twelve consequetive months.

31. The transformational puzzle toy of claim 5, in which each of said closed loops includes graphic representations applied in a predetermined pattern to the exterior surfaces of each of the 96 triangular facets of said tetrahedron bodies, each of said triangular facets having a unique outer appearance, such that a plurality of eight such loops can be arranged to make said two frequency rhombic dodecahedron having an outer surface in which each of said graphically distinct 96 triangular facets appears once without duplication.

32. The transformational construction puzzle toy of claim 5, wherein each of the graphically distinct 96 triangular facets contains 96 different number indicia on the exterior surface.

33. The transformational construction puzzle toy of claim 5, where said means for securing said loops into contracted and multiple unit configurations consists of an interior arrangement of 48 magnets and 48 units of ferromagnetic material, such that each tetrahedron of each loop contains two magnets and two units of ferromagnetic material.

34. The transformational construction puzzle toy of claim 33, where each of the 48 magnets has identical polarity with respect to the face to which it is attached.

* * * * *